US006740481B2

(12) United States Patent
Nagaoka et al.

(10) Patent No.: US 6,740,481 B2
(45) Date of Patent: May 25, 2004

(54) SILVER HALIDE COLOR PHOTOGRAPHIC MATERIAL

(75) Inventors: Katsuro Nagaoka, Minami-Ashigara (JP); Minoru Sato, Tokyo (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 199 days.

(21) Appl. No.: 10/098,314

(22) Filed: Mar. 18, 2002

(65) Prior Publication Data

US 2003/0068589 A1 Apr. 10, 2003

(30) Foreign Application Priority Data

Mar. 19, 2001 (JP) ..... 2001-079388
May 10, 2001 (JP) ..... 2001-140313

(51) Int. Cl.[7] ..... G03C 1/08

(52) U.S. Cl. ..... 430/508; 430/506; 430/505; 430/504; 430/503; 430/502; 430/567

(58) Field of Search ..... 430/502, 503, 430/504, 505, 506, 508, 567

(56) References Cited

U.S. PATENT DOCUMENTS 4,663,271 A * 5/1987 Nozawa et al. ..... 430/503
2003/0064329 A1 * 4/2003 Abe et al. ..... 430/504
2003/0077548 A1 * 4/2003 Sato et al. ..... 430/508
2003/0087209 A1 * 5/2003 Kuramitsu et al. ..... 430/504

FOREIGN PATENT DOCUMENTS

JP 2-124566 5/1990
JP 3-122636 5/1991

* cited by examiner

*Primary Examiner*—Geraldine Letscher
(74) *Attorney, Agent, or Firm*—Sughrue Mion, PLLC

(57) ABSTRACT

A silver halide color photographic material comprises at least one blue-sensitive emulsion layer (BL layer), at least one green-sensitive emulsion layer (GL layer) and at least one red-sensitive emulsion layer (RL layer) on a support. A maximum absorption wavelength of the green-sensitive emulsion layer represented by λmax(G) is in the range of 500 nm≦λmax(G)≦570 nm. The photographic material further has at least one short-wavelength-green-sensitive emulsion layer (CL layer) meeting the following requirements (i) and (ii):

(i) a maximum absorption wavelength of the CL layer represented by λmax(C) being in the range of 490 nm≦λmax(C)≦560 nm, and 80 nm≧λmax(G)−λmax(C)≧5 nm, and (ii) the total iodine amount of silver halide grains contained in the CL layer being in the range from 60% to 300% of that contained in the green-sensitive emulsion layer.

20 Claims, No Drawings

SILVER HALIDE COLOR PHOTOGRAPHIC MATERIAL

CROSS-REFERENCE TO RELATED APPLICATIONS

This application is based upon and claims the benefit of priority from the prior Japanese Patent Applications No. 2001-079388, filed Mar. 19, 2001; and No. 2001-140313, filed May 10, 2001, the entire contents of both of which are incorporated herein by reference.

BACKGROUND OF THE INVENTION

1. Field of the Invention

The present invention relates to a silver halide color photographic material, specifically, a color reversal material excellent in the color saturation, the faithfulness of intermediate color, and description.

Further, the present invention relates to a method of forming a color reversal image using the above-mentioned silver halide color photographic material.

2. Description of the Related Art

In the color photographic material, if the improvement of saturation is limited only to primary colors, it can be realized by lessening the overlap in the spectral sensitivity distribution of blue-, green- and red-lightsensitive emulsion layers, but in this case, the faithfulness of intermediate color is deteriorated (for example, Satoru Honjou, "Characteristic and Technique of Color Reversal Film" Journal of Japan Photography Academy Vol.48, p.274 (1985)). It is disclosed in Jpn. Pat. Appln. KOKAI Publication No. (hereinafter, referred to as JP-A-) 2-272450, JP-A's-2-272540 and 3-122636 that a color photographic material having a silver halide emulsion layer from which a development-inhibiting agent is released in black and white development and substantially no contribution is provided to the formation of color dye, is effective in order to improve the color saturation of a color reversal photographic material and the faithfulness of hue including an intermediate color. However, according to these techniques, although the improvement in the saturation of primary colors and the discrimination in the region of from blue to green are superior, there is a problem in the faithfulness of the intermediate colors, therefore it is necessary to solve the problem.

As a technique for improving the color fidelity, as described in the specifications of U.S. Pat. Nos. 4,663,271, 4,705,744 and 4,707,436, JP-A's-62-160448 and 63-89850, there is disclosed an invention in which an inter image effect-donating layer having a different spectral sensitivity distribution from that of blue-, green- and red-main light-sensitive layers is arranged. However, there is hardly found a specific description of actually realizing this in the system of a color reversal photographic material. Even if the color reversal material is actually manufactured by such configuration, the inter-image effect from a donor layer is not sufficiently expressed, the color-mixing from a layer provided in the vicinity of the donating layer is enhanced, and it was found out that the color of a photographed body cannot be adequately and faithfully reproduced.

Further, in JP-A's-2-272450, 3-122636 and 8-328212, those concerning a method of providing the inter image effect-donating layer and a method of setting spectral sensitivity in the silver halide color photographic material are disclosed. However, since the inter-image effect from a donor layer is not adequately expressed even by these configurations and a color-sensitive color layer provided in the vicinity of the donor layer generates an unnecessary color and color opaque by an emulsion which the donor layer contains, it was grasped that the color of a photographed body cannot be adequately and faithfully reproduced.

JP-A's-4-039653 and 4-039654 disclose techniques concerning the gradation design of a color reversal film for improving the flesh color fidelity. However, these techniques designed to optimized the flesh color reproduction by "lowering the inclination in D-log E curve of magenta in comparison with that of yellow", and bring about serious defect that a gray color changes depending on its concentration. The term "flesh color" herein means the light-skin of Macbeth color chart No.2. "These publications are silent about any method of technically improving the defect. Further, these are techniques for stabilizing the tint change of flesh colors having different concentrations, and nothing is taken into consideration concerning the improvement in the faithfulness of various intermediate colors.

Therefore, in the color reproduction of a color reversal photographic material, development in a technique by which both saturation and faithfulness are compatible, is desired.

BRIEF SUMMARY OF THE INVENTION

It is an object of the present invention to provide a silver halide color photographic material, specifically, a color reversal material in which the saturation of color reproduction and the hue faithfulness of intermediate color are improved.

Further, it is also an object of the present invention to provide a method of forming a color reversal image using the above-mentioned silver halide color photographic material.

The inventors have conducted extensive and intensive studies, and as a result, the objects of the present invention have been attained by the procedures below.

(1) A silver halide color photographic material comprising at least one blue-sensitive emulsion layer (BL layer), at least one green-sensitive emulsion layer (GL layer) and at least one red-sensitive emulsion layer (RL layer) on a support, wherein, a maximum absorption wavelength of the green-sensitive emulsion layer represented by $\lambda max(G)$ being in the range of $500\ nm \leqq \lambda max(G) \leqq 570\ nm$, and the photographic material further having at least one short-wavelength-green-sensitive emulsion layer (CL layer) meeting the following requirements (i) and (ii):

(i) a maximum absorption wavelength of the CL layer represented by $\lambda max(C)$ being in the range of $490\ nm \leqq \lambda max(C) \leqq 560\ nm$, and $80\ nm \geqq \lambda max(G) - \lambda max(C) \geqq 5\ nm$, and (ii) the total iodine amount of silver halide grains contained in the CL layer being in the range from 60% to 300% of that contained in the green-sensitive emulsion layer (2) A silver halide color photographic material comprising at least one blue-sensitive emulsion layer (BL layer), at least one green-sensitive emulsion layer (GL layer) and at least one red-sensitive emulsion layer (RL layer) on a support, wherein, a weight-averaged wavelength of spectral sensitivity distribution of the green-sensitive emulsion layer represented by λG being in the range of 500 nm≦λG≦570 nm, and the photographic material further having at least one short-wavelength-green-sensitive emulsion layer (CL layer) meeting the following requirements (iii) and (iv):

(iii) a weight-averaged wavelength of spectral sensitivity distribution of the CL emulsion layer represented by λC being in the range of 490 nm≦λC≦560 nm, and 80 nm≧λG−λC≧5 nm, and (iv) the total iodine amount of silver halide grains contained in the CL layer being in the range from 60% to 300% of that contained in the green-sensitive emulsion layer (3) A silver halide color photographic material comprising at least one blue-sensitive emulsion layer (BL layer), at least one green-sensitive emulsion layer (GL layer) and at least one red-sensitive emulsion layer (RL layer) on a support, wherein, a maximum absorption wavelength of the blue-sensitive emulsion layer represented by λmax(B) being in the range of 440 nm≦λmax(B)≦500 nm, and the photographic material further having at least one short-wavelength-blue-sensitive emulsion layer (VL layer) meeting the following requirements (v) and (vi):

(v) a maximum absorption wavelength of the VL layer represented by λmax(V) being in the range of 400 nm≦λmax(V)≦460 nm, and 100 nm≧λmax(B)−λ2max(V)≧5 nm, and (vi) the total iodine amount of silver halide grains contained in the VL layer being in the range from 40% to 250% of that contained in the blue-sensitive emulsion layer (4) A silver halide color photographic material comprising at least one blue-sensitive emulsion layer (BL layer), at least one green-sensitive emulsion layer (GL layer) and at least one red-sensitive emulsion layer (RL layer) on a support, wherein, a weight-averaged wavelength of spectral sensitivity distribution of the blue-sensitive emulsion layer represented by λB being in the range of 440 nm≦λB≦500 nm, and the photographic material further having at least one short-wavelength-blue-sensitive emulsion layer (VL layer) meeting the following requirements (vii) and (viii):

(vii) a weight-averaged wavelength of spectral sensitivity distribution of the VL layer represented by λV being in the range of 400 nm≦λV≦460 nm, and 100 nm≧λB−λV≧5 nm, and (viii) the total iodine amount of silver halide grains contained in the VL layer being in the range from 40% to 250% of that contained in the blue-sensitive emulsion layer (5) A silver halide color photographic material comprising at least one blue-sensitive emulsion layer (BL layer), at least one green-sensitive emulsion layer (GL layer) and at least one red-sensitive emulsion layer (RL layer) on a support, wherein, a maximum absorption wavelength of the green-sensitive emulsion layer represented by λmax(G) being in the range of 500 nm≦λmax(G)≦570 nm, a maximum absorption wavelength of the blue-sensitive emulsion layer represented by λmax(B) being in the range of 440 nm≦λmax(B)≦500 nm, and the photographic material further having at least one short-wavelength-green-sensitive emulsion layer (CL layer) and at least one short-wavelength-blue-sensitive emulsion layer (VL layer) each meeting the following requirements (ix) and (x):

(ix) a maximum absorption wavelength of the CL layer represented by λmax(C) being in the range of 490 nm≦λmax(C)≦560 nm, and 80 nm≧λmax(G)−λmax(C)≧5 nm, and (x) a maximum absorption wavelength of the VL layer represented by λmax(V) being in the range of 400 nm≦λmax(V)≦460 nm, and 100 nm≧λmax(B)−λmax(V)≧5 nm (6) A silver halide color photographic material comprising at least one blue-sensitive emulsion layer (BL layer), at least one green-sensitive emulsion layer (GL layer) and at least one red-sensitive emulsion layer (RL layer) on a support, wherein, a weight-averaged wavelength of spectral sensitivity distribution of the green-sensitive emulsion layer represented by λG being in the range of 500 nm≦λG≦570 nm, a weight-averaged wavelength of spectral sensitivity distribution of the blue-sensitive emulsion layer represented by λB being in the range of 440 nm≦λB≦500 nm, and the photographic material further having at least one short-wavelength-green-sensitive emulsion layer (CL layer) and at least one short-wavelength-blue-sensitive emulsion layer (VL layer) each meeting the following requirements (xi) and (xii):

(xi) a weight-averaged wavelength of spectral sensitivity distribution of the CL layer represented by λC being in the range of 490 nm≦λC≦560 nm, and 80 nm≧λG−λC≧5 nm, and (xii) a weight-averaged wavelength of spectral sensitivity distribution of the VL layer represented by λV being in the range of 400 nm≦λV≦460 nm, and 100 nm≧λB−λV≧5 nm (7) The silver halide color photographic material described in any one of (1) to (6) above, wherein image dye is not substantially formed in the CL layer and/or the VL layer.

(8) The silver halide color photographic material described in any one of (1), (2), (5), (6) and (7) above, wherein a non-lightsensitive layer having a color mixing prevention ability, being provided between the CL layer and a lightsensitive emulsion layer other than the CL layer.

(9) A method of forming a color reversal image comprising black and white developing any one of the silver halide color photographic materials described in (1) to (8) above, followed by color developing the same.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

"The maximum absorption wavelength of the lightsensitive emulsion layer represented by λmax(n)" mentioned in the present invention, wherein n represents a sensitive color of the emulsion layer and is selected from the characters of V, B, C, G and R, is a wavelength at which the absorption ratio of said emulsion layer becomes a maximum value. The wavelength of λmax(n) is within the wavelength region of 350 nm or more and 700 nm or less. Each of the wavelength λmax(n) may be obtained by pealing the emulsion layer from the coated material and measuring its absorption property.

"The weight-averaged wavelength of spectral sensitivity distribution of a lightsensitive emulsion layer represented by λn" mentioned in the present invention, wherein n represents a sensitive color of the emulsion layer and is selected from the characters of V, B, C, G and R, is defined in the following $$\lambda n = \int_{350}^{700} \lambda \cdot Sn(\lambda)\, d\lambda \Big/ \int_{350}^{700} Sn(\lambda)\, d\lambda$$

wherein Sn (λ) is the spectral distribution of the sensitivity giving a color density in an amount of 0.5 times the full color density of each of the lightsensitive emulsion layers, wherein n represent a color to which an emulsion layer is sensitive and is selected from the characters of V, B, C, G and R. Provided that when the lightsensitive emulsion layer does not form a color dye, Sn (λ) is defined as the spectral distribution of the sensitivity giving a blackened silver density in an amount of 0.2 times the maximum blackened silver density obtained by white light exposure when a sample of a single-layered photographic material in which only the emulsion layer is coated on a support, is silver-developed.

In the invention, the color density of each color-sensitive layer is defined as that obtained by processing a photographic material with the same processing as that described later in the section of Examples of the specification. Provided that when a lightsensitive emulsion layer does not form a color dye, and thus it is to be silver-developed, the density is defined as that obtained by processing a photographic material with the same processing as that described later in the section of Examples of the specification, except that the reversal, color development, pre-bleaching, and bleaching steps are omitted.

In order to enhance saturation without deterioration in color fidelity, it is important to balance among the spectral sensitivity distribution of the emulsion layers. Especially, since distinction between similar colors largely affects the color fidelity and saturation, it is important to control the spectral sensitivity distribution between the green-sensitive emulsion layer and the short-wavelength-green-sensitive emulsion layer and between the blue-sensitive emulsion layer and the short-wavelength-blue sensitive emulsion layer.

λC of the short-wavelength-green-sensitive emulsion layer (CL layer) is 490 nm≦λC≦560 nm, and the CL layer exhibits an orange color, and is required to be a layer sensitive to cyan light. λC is preferably 510 nm≦λC≦540 nm, and more preferably 520 nm≦λC≦535 nm.

In order to realize such an absorption wavelength of the CL layer, it is preferable to add a quinoline type spectral sensitizing dye that is described in JP-A-5-341429 to the silver halide emulsion that is contained in said layer.

Further, λG of the green-sensitive emulsion layer (GL layer) is required to be 500 nm≦λG≦570 nm, and the GL layer exhibits a magenta color, and is a layer sensitive to green light. λG is preferably 535 nm≦λG≦560 nm, and more preferably 545 nm≦λG≦555 nm.

The relation between the above-mentioned λG and λC is required to be 80 nm≧λG−λC≧5 nm, preferably 60 nm≧λG−λ≧10 nm, and the more preferable relation is 40 nm≧λG−λC≧15 nm.

λV of the short-wavelength-length-blue-sensitive emulsion layer (VL layer) is required to be 400 nm≦λV≦460 nm. λV is preferably 410 nm≦λV≦450 nm, and more preferably 420 nm≦λV≦440 nm.

Further, λB of the blue-sensitive emulsion layer (BL layer) is required to be 440 nm≦λB≦500 nm, preferably 450 nm≦λB≦490 nm, and more preferably 460 nm≦λB≦480 nm.

The relation between the above-mentioned λB and λV is required to be 100 nm≧λB−λV≧5 nm, preferably 75 nm≧λB−λ≧10 nm, and the more preferable relation is 50 nm≧λB−λV≧15 nm.

In many cases, since a maximum absorption wavelength λmax(n) of an emulsion layer originates in the absorption of J aggregate of the spectral sensitizing dye in the emulsion, λmax(n) coincides with the weight-averaged wavelength of spectral sensitivity distribution represented by λn. However, depending on the adsorption state and quantum efficiency of the spectral sensitizing dye, the maximum absorption wavelength of an emulsion sometimes does not correspond to the weight-averaged wavelength of spectral sensitivity distribution of the emulsion. In this case, the preferable ranges with respect to the maximum absorption wavelength of λmax(n) of an emulsion layer is applied to the preferable ranges with respect to the weight-averaged wavelength of spectral sensitivity distribution of λn, except that in the description of the preferable ranges of λn, λn is replaced with λmax(n).

In the spectral sensitivity possessed by a human, λC is a wavelength in a wavelength region having, so-called, a negative spectral sensitivity. Giving an interimage effect from the CL layer to another color-sensitive layer realizes spectral sensitivity similar to human eyes, and therefore, is important to attain the faithful color reproduction, which is the object of the invention.

Further, in the spectral sensitivity possessed by a human, λV is also a wavelength in a wavelength region having, so-called, a negative spectral sensitivity. Since λV is shorter wavelength than λC, giving an interimage effect from VL layer to another layer can realize the color fidelity in a shorter wavelength region, that is, in blue and green, and also enhance the saturation. These advantages could not be expected at all from the findings regarding a conventional silver halide color photographic material having three to four kinds of spectral property.

The CL layer and the VL layer contain a color coupler in the same manner as usual red-sensitive, green-sensitive, and blue-sensitive emulsion layers, and can form a color dye by the reduction reaction of silver halide that is contained in said layers. In this case, the colored hue provides any of the colors of orange, magenta and yellow, which are in a complementary color relationship of the absorption wavelength of the respective layers, the CL layer reveals most preferably two colors of magenta and yellow, and the VL layer reveals preferably the colors of yellow.

However, it is preferable that the CL layer and/or the VL layer, preferably the CL layer and the VL layer, do not substantially form an image dye, and it is most preferable that they do not contain a color coupler and do not reveal color by color development processing, i.e., the layers exhibit no coloring. Wherein "do not substantially form an image dye" means that contribution to all color densities is extremely low, and means that it is 5% or less for all color densities and the absolute value of the color densities is 0.2 or less. It is preferable to contain no color coupler in order to generate no dye formation at all. When no color is provided, the CL layer and the VL layer become layers which exist for only providing the inter-image effect to other color sensitive emulsion layers.

The total iodine amount (I(n)) mentioned in the invention is represented by a product of the coated silver amount (AgW(n)) of silver halide grains that are contained in said color sensitive emulsion layers by the average silver iodide content (I mol %(n)), wherein n represents a sensitive color, and is selected from the characters of V, B, C, G and R. For example, when coated silver amount of GL layer, AgW(G)=1 g/m$^2$, average silver iodide content of GL layer, I mol %(G)=5 mol %, coated silver amount of CL layer, AgW(C)=0.5 g/m$^2$, and average silver iodide content of CL layer, I mol %(C)=12 mol %, I(G)=5 and I(C)=6. Namely the total iodine amount that is contained in the CL layer becomes 120% of the total iodine amount that is contained in the GL layer, which means satisfying the range specified in the specification.

Such constitution is necessary for providing an adequate inter-image effect to another color sensitive layer. There is no example in which the iodine amount of silver halide grains that are contained in the layer having such an λn as was set to such a high value. Therefore, the advantage, i.e., color fidelity is improved by setting the iodine content to such a high value, could not be expected at all from the technical contents that were conventionally disclosed.

It is preferable that the total iodine amount I(C) of silver halide grains that are contained in the CL layer is 70% or more and 200% or less of the total iodine amount I(G) of silver halide grains that are contained in the GL layer, and more preferably 80% or more and 150% or less.

Further, it is preferable that the total iodine amount I(V) of silver halide grains that are contained in the VL layer is 50% or more and 200% or less of the total iodine amount I(B) of silver halide grains that are contained in the BL layer, and more preferably 55% or more and 150% or less.

In order to satisfy the requisite, it is required that the average silver halide contents, I mol % (C) and I mol % (V), which are contained in the CL layer and the VL layer, respectively, are set to a higher value than usual, preferably 1.2-fold or more and 6-fold or less of I mol % (G) or I mol % (B), further preferably 2-fold or more and 4-fold or less, and most preferably 2.5-fold or more and 3.5-fold or less.

The values of I mol % (C) and I mol % (V) are preferably 5 mol % or more and 40 mol % or less, more preferably 7 mol % or more and 20 mol % or less, and further more preferably 9 mol % or more and 15 mol % or less. Further, the values of I mol % (G) and I mol % (B) are preferably 0.8 mol % or more and 7 mol % or less, more preferably 1 mol % or more and 6 mol % or less, and further more preferably 1.5 mol % or more and 4 mol % or less.

The coated silver amount, AgW(C) of silver halide grains that are contained in the CL layer with respect to the coated silver amount, AgW(G) of silver halide grains that are contained in the GL layer is 0.1-fold or more and 0.6-fold or less, and preferably 0.2-fold or more and 0.5-fold or less, and more preferably 0.3-fold or more and 0.4-fold or less.

The value AgW(C) is preferably 0.05 g/m$^2$ or more and 0.6 g/m$^2$ or less, more preferably 0.1 g/m$^2$ or more and 0.55 g/m$^2$ or less, and further more preferably 0.15 g/m$^2$ or more and 0.5 g/m$^2$ or less. The value AgW(G) is preferably 0.5 g/m$^2$ or more and 2.0 g/m$^2$ or less, more preferably 0.7 g/m$^2$ or more and 1.8 g/m$^2$ or less, and further more preferably 0.9 g/m$^2$ or more and 1.6 g/m$^2$ or less.

Further, the coated silver amount, AgW(V) of silver halide grains that are contained in the VL layer with respect to the coated silver amount, AgW(B) of silver halide grains that are contained in the BL layer is 0.1-fold or more and 0.6-fold or less, and preferably 0.15-fold or more and 0.5-fold or less, and more preferably 0.2-fold or more and 0.4-fold or less.

The value AgW(V) is preferably 0.03 g/m$^2$ or more and 0.5 g/m$^2$ or less, more preferably 0.06 g/m$^2$ or more and 0.4 g/m$^2$ or less, and further more preferably 0.08 g/m$^2$ or more and 0.3 g/m$^2$ or less. The value AgW(B) is preferably 0.3 g/m$^2$ or more and 1.5 g/m$^2$ or less, more preferably 0.4 g/m$^2$ or more and 1.3 g/m$^2$ or less, and further more preferably 0.5 g/m$^2$ or more and 1.1 g/m$^2$ or less.

In order to enhance the total iodine amount of silver halide grains that are contained in the CL layer or VL layer and to improve the color fidelity over wide exposure latitude, it is preferable that each of these layers is configured with two layers or more and a plural number of silver halide emulsions are contained in a single layer. The number of layers of the CL layer and VL layer are preferably one layer or more and four layers or less, more preferably one layer or more and three layers or less, and further more preferably one layer or more and two layers or less. In a plurality of emulsions that are contained in a single layer at this time, the amount of the emulsion having a higher sensitivity is preferably 1.6-fold or more and 100-fold or less to the amount of the emulsion having a lower sensitivity, and more preferably 2-fold or more and 50-fold or less. Further, it is preferable that a plurality of emulsions that are contained in a single layer have sphere-equivalent average grain sizes of silver halide grains which differ mutually 1.2-fold or more.

The sphere-equivalent average grain size is the volume weighted average of the sphere-equivalent diameters of grains contained. The sphere-equivalent size of a grain means the diameter of a sphere that has the same volume as the volume of said grain.

The photographic material of the invention has at least one layer each of a blue-sensitive silver halide emulsion layer (BL layer), a green-sensitive silver halide emulsion layer (GL layer), a red-sensitive silver halide emulsion layer (RL layer), and a short-wavelength-green-sensitive emulsion layer (CL layer) which is a slightly shorter wavelength than that of the green-sensitive silver halide emulsion layer, or the short-wavelength-blue-sensitive emulsion layer (VL layer) which is a slightly shorter wavelength than that of the blue-sensitive silver halide emulsion layer, on a support. It is preferable, in the invention, that RL, GL and BL are coated in this order from a side nearer to the support, and it is preferable that the respective color sensitive layers have a unit configuration in which two or more of the lightsensitive emulsion layers having different speeds are contained. In particular, a configuration in which the respective color sensitive layers comprise three lightsensitive emulsion layers of a low-speed layer, a medium-speed layer, and a high-speed layer from a side nearer to the support is preferable. These are described in Jpn. Pat. Appln. KOKOKU Publication No. (hereinafter referred to as JP-B-) 49-15495, JP-A-59-202464 and the like.

Further, the CL layer and the VL layer can be provided, in relation to the RL, GL and BL layers, at a position that is 1) closer than the RL layer to a support, 2) intermediate between the RL layer and the GL layer, 3) intermediate between the GL layer and the BL layer, and 4) farther than the BL layer from a support.

Among these, it is most preferable that the CL layer be positioned at item 1) mentioned above. Further, when a plurality of CL layers are provided, it is preferable that either items 1) and 2), or items 1) and 3) are used in combination, and most preferable that items 1) and 3) are used in combination.

Further, it is preferable that the VL layer is provided intermediate between the GL layer and the BL layer, or at a farther position than the BL layer from a support, and most preferable that it is provided intermediate between the GL layer and the BL layer.

In one of the preferred embodiments of the invention, a lightsensitive element on which the following layers are coated on a support in this order, can be mentioned: an under coat layer/an anti-halation layer/a 1st intermediate layer/a CL layer unit/a 2nd intermediate layer/a RL layer unit (comprising, from the side closer to the support, three layers of a low-speed red-sensitive layer/a medium-speed red-sensitive layer/a high-speed red-sensitive layer)/a 3rd intermediate layer/a GL unit (comprising, from the side closer to the support, three layers of a low-speed green-sensitive layer/a medium-speed green-sensitive layer/a high-speed green-sensitive layer)/a yellow filter layer/a VL layer/a 4th intermediate layer/a BL layer unit (comprising, from the side closer to the support, three layers of a low-speed blue-sensitive layer/a medium-speed blue-sensitive layer/a high-speed blue-sensitive layer)/a 1st protective layer/a 2nd protective layer/a 3rd protective layer.

In the above embodiment, each of the 1st, 2nd, 3rd and 4th intermediate layers may be in a configuration of one layer or two or more layers.

The intermediate layer may contain a coupler and a DIR compound such as those described in the specifications of JP-A's-61-43748, 59-113438, 59-113440, 61-20037 and 61-20038. The intermediate layer may also contain a color mixing prevention agent, as usually do so.

In the photographic material of the invention, a non-color forming inter layer may be included in a lightsensitive unit having the same color sensitivity may. Further, the interlayer preferably contains a compound capable of being selected as a competing compound to be described later.

It is also preferable that the photographic material of the invention may have a three-layered protective layer structure comprising 1st, 2nd and 3rd protective layers. When the number of the protective layers is two or three, the 2nd protective layer preferably contains fine grain silver halide having an equivalent sphere average size of 0.10 $\mu$m or less. The silver halide is preferably silver bromide or silver iodobromide.

The lightsensitive emulsion layers other than the CL layer which are mentioned in the specification substantially mean the RL, GL, BL and VL layers. A non-lightsensitive layer having color mixing prevention ability which is provided between these layers and the CL layer has an effect in which a developing agent in an oxidized form generated from one layer does not transfer to a neighboring layer across the non-lightsensitive layer.

The non-lightsensitive layer is a layer other than a lightsensitive layer in which silver halide grains contained therein respond to photo stimulation to carry out latent image formation.

The layer having a color mixing prevention ability preferably is a gelatin layer with a film thickness of 0.5 $\mu$m or more and 5 $\mu$m or less and/or contains a competing compound. More preferable film thickness is 1 $\mu$m or more and 4 $\mu$m or less, and further preferably 1.5 $\mu$m or more and 3 $\mu$m or less.

The layer having a color mixing prevention ability preferably contains a compound that reacts with a color developing agent in an oxidized form in competition with an image forming coupler as a competing compound and does not form an dye image. Specifically, the layer preferably contains reducing compounds such as hydroquinones, catechols, hydrazines, and sulfonamidephenols, or compounds capable of coupling with a developing agent in an oxidized form but does not substantially form color images (e.g., colorless couplers disclosed in German Patent No. 1,155,675, British Patent 861,138, U.S. Pat. Nos. 3,876,428, and 3,912,513, or couplers whose dyes produced therefrom flow out during a processing step, such as those disclosed in JP-A-6-83002).

More preferable competing compounds are hydroquinone compounds and hydrazine compounds, and hydroquinone compounds are more preferable. The most preferable hydroquinone compounds are those represented by the general formula (A) described in JP-A-10-026816

(A)

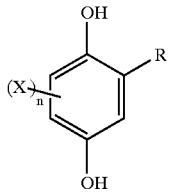

In the general formula (A), R represents an alkyl group, and X represents a halogen atom, an alkoxy group, an aryloxy group, an alkylthio group, an arylthio group, an acylamido group, a sulfonamido group, a carbamoyl group, a sulfamoyl group, a sulfonyl group, an ureido group, an alkoxycarbonyl group, an aryloxycarbonyl group, an alkoxycarbonylamino group, an aryloxycarbonylamino group, an acyl group, or a heterocyclic group. n represents an integer of 0 to 3, and when n is 2 to 3, a plurality of X's may be the same or different, respectively.

Further, the addition amount of these competing compounds to an intermediate layer sandwiched between a lightsensitive layer and the nearest lightsensitive layer thereto is 50 mg/m$^2$ or more and 1000 mg/m$^2$ or less. When the intermediate layer is configured with two layers or more, the addition amount is the total amount of the layers. More preferably the addition amount is 150 mg/m$^2$ or more and 700 mg/m$^2$ or less, and 250 mg/m$^2$ or more and 500 mg/m$^2$ or less is most preferable. Such a coating amount of the competing compound is more than that used in the conventional intermediate layer. It could not be expected that providing a non-light sensitive layer having a color mixing prevention ability between the CL layer and a lightsensitive layer other than the CL layer as mentioned above, and using a large amount of the competing compound in the non-photosensitive layer could attain highly faithful color reproduction.

Usually, the maximum absorption wavelength of the RL layer or the weight-averaged wavelength of spectral sensitivity distribution ($\lambda$R) is 580 nm$\leqq\lambda$R$\leqq$680 nm, while in the invention, $\lambda$R is preferably 550 nm $\leqq\lambda$R$\leqq$670 nm. It is more preferably 580 nm$\leqq\lambda$R$\leqq$660 nm, and most preferably 600 nm$\leqq\lambda$R$\leqq$650 nm.

The photographic material of the invention contains an image forming coupler. The image forming coupler means a coupler that forms an image forming dye by coupling with an aromatic primary amine color developing agent in an oxidized form, and a color image is generally obtained using a yellow coupler, a magenta coupler and a cyan coupler in combination.

The image forming coupler of the invention is preferably used by being added in a lightsensitive emulsion layer sensitive to light which is in the relation of complementary color to the color hue of the coupler. Namely, the yellow coupler is added to the blue-sensitive emulsion layer, the magenta coupler to the green-sensitive emulsion layer, and the cyan coupler to the red-sensitive emulsion layer. Further, it is preferable for purposes of improving the shadow description property and the like that the coupler that is not in relation of complementary color is used in combination, e.g., the cyan coupler or the yellow coupler is used together in the green-sensitive emulsion layer in accordance with the objective, etc. The addition of the coupler which is not in the relation of complementary color differs depending on the color-forming efficiency of the coupler, but is generally 1 mol % or more and 15 mol % or less based on a coupler which is in relation of complementary color, preferably 2 mol % or more and 12 mol % or less, and more preferably 3 mol % or more and 10 mol % or less.

Yellow couplers:

couplers represented by formulas (I) and (II) in EP502,424A;
couplers (particularly Y-28 on page 18) represented by formulas (1) and (2) in EP513,496A;
couplers represented by formula (I) in claim 1 of EP568,037A;
couplers represented by formula (I) in column 1, lines 45 to 55 of U.S. Pat. No. 5,066,576;
couplers represented by formula (I) in paragraph 0008 of JP-A-4-274425;
couplers (particularly D-35) described in claim 1 on page 40 of EP498,381A1;
couplers (particularly Y-1 and Y-54) represented by formula (Y) on page 4 of EP447,969A1;
couplers represented by formulas (II) to (IV) in column 7, lines 36 to 58 of U.S. Pat. No. 4,476,219; and so on Magenta couplers:

couplers described in JP-A-3-39737 (e.g., L-57, L-68, and L-77);
couplers described in EP456,257 (e.g., A-4-63, and A-4-73 and A-4-75;
couplers described in EP486,965 (e.e., M-4, M-6, and M-7;
couplers described in EP571,959A (e.e., M-45);
couplers described in JP-A-5-204106 (e.g., M-1);
couplers described in JP-A-4-362631 (e.g., M-22);
couplers represented by general formula (MC-1) described in JP-A-11-119393 (e.g., CA-4, CA-7, CA-12, CA-15, CA-16, and CA-18); and so on Cyan couplers:

couplers described in JP-A-4-204843 (e.g., CX-1, -3, -4, -5, -11, -12, -14, and -15);
couplers described in JP-A-4-43345 (e.g., C-7, -10, -34 and, -35, and (I-1) and (I-17);
couplers represented by formulas (Ia) or (Ib) in claim 1 of JP-A-6-67385;
couplers represented by general formula (PC-1) described in JP-A-11-119393 (e.g., CB-1, CB-4, CB-5, CB-9, CB-34, CB-44, CB-49 and CB-51);
couplers represented by general formula (NC-1) described in JP-A-11-119393 (e.g., CC-1 and CC-17); and so on These couples can be introduced into a photographic material by various known dispersing methods. It is preferable that an water-in-oil dispersing method by dissolving a coupler to a high-boiling organic solvent, in combination with a low-boiling solvent, if necessary, and dispersing it by emulsification to a gelatin solution, thereby adding it to a silver halide emulsion.

Examples of the high-boiling solvent used in this oil-in-water dispersion method are described in, e.g., U.S. Pat. No. 2,322,027, the disclosure of which is herein incorporated by reference. Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230, JP-B-53-41091, and EP029104, the disclosures of which are herein incorporated by reference. Dispersion using an organic solvent-soluble polymer is described in PCT International Publication WO88/00723, the disclosure of which is herein incorporated by reference.

Examples of the high-boiling solvent usable in the above-mentioned oil-in-water dispersion method are phthalic acid esters (e.g., dibutylphthalate, dioctylphthalate, dicyclohexylphthalate, bis(2-ethylhexyl)phthalate, decylphthalate, bis(2,4-di-tert-amylphenyl)isophthalate, and bis(1,1-diethylpropyl)phthalate), esters of phosphoric acid and phosphonic acid (e.g., diphenylphosphate, triphenylphosphate, tricresylphosphate, 2-ethylhexyldiphenylphosphate, dioctylbutylphosphate, tricyclohexylphosphate, tri-2-ethylhexylphosphate, tridodecylphosphate, and bis(2-ethylhexyl) phenylphosphate), benzoic acid esters (e.g., 2-ethylhexylbenzoate, 2,4-dichlorobenzoate, dodecylbenzoate, and 2-ethylhexyl-p-hydroxybenzoate), amides (e.g., N,N-diethyldodecaneamide, N,N-diethyllaurylamide, N,N,N,N-tetrakis(2-ethylhexyl) isophthalic acid amide), alcohols and phenols (e.g., isostearylalcohol and 2,4-di-tert-amylphenol), aliphatic esters (e.g., dibutoxyethyl succinate, bis(2-ethylhexyl) succinate, 2-hexyldecyl tetradecanoate, tributyl citrate, diethyl azelate, isostearyl lactate, and trioctyl tosylate), aniline derivatives (e.g., N,N-dibutyl-2-butoxy-5-tert-octylaniline), chlorinated paraffins (paraffins containing 10% to 80% of chlorine), trimesic acid esters (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl)phenol), carboxylic acids (e.g., 2-(2,4-di-tert-amylphenoxy butyric acid and 2-ethoxyoctanedecanoic acid), alkylphosphoric acids (e.g., bis(2-ethylhexyl)phosphoric acid and diphenylphosphoric acid). In addition to the above high-boiling solvents, compounds described in, e.g., JP-A-6-258803, the disclosure of which is herein incorporated by reference, can also be preferably used as high-boiling solvents.

The weight ratio of a high-boiling organic solvent to a coupler is preferably 0 to 2.0, more preferably, 0 to 1.0, and most preferably, 0 to 0.4.

As a co-solvent, it is also possible to use an organic solvent (e.g., ethyl acetate, butyl acetate, ethyl propionate, methylethylketone, cyclohexanone, 2-ethoxyethylacetate, and dimethylformamide) having a boiling point of 30° C. to about 160° C.

The content of each of yellow, magenta and cyan couplers in a photographic material is preferably 0.01 to 10 g, more preferably 0.1 to 2 g per $m^2$. A proper content of each of the couplers, per mol of silver halide contained in an emulsion layer(s) having sensitivity to the same color, is $1\times10^{-3}$ to 1 mol, and preferably $2\times10^{-3}$ to $3\times10^{-1}$ mol.

When the lightsensitive layer is composed of a unit structure having two or more lightsensitive emulsion layers different in speed, the content, per mol of silver halide, of the coupler of the invention preferably is such a configuration that the layer having higher speed contains more couplers.

To prevent deterioration of the photographic properties caused by formaldehyde gas, the photographic material of the invention preferably contains a compound described in U.S. Pat. Nos. 4,411,987 or 4,435,503, which can react with and fix formaldehyde gas.

The emulsion used in the silver halide color photographic material of the invention preferably contains the tabular silver halide grains (hereinafter also referred to as "tabular grains") having an aspect ratio of 1.5 or more and less than 100. Herein, the tabular silver halide grains are the general name of silver halide grains having one twin plane or two or more of the parallel twin planes. The twin plane means a (111) face on the two sides of which ions at all lattice points have a mirror image relationship. The tabular grain is constituted by two opposing and parallel main planes and side faces linking these main planes. When the tabular grain is viewed in a direction perpendicular to the main plane, the main plane has any of triangular, hexagonal or round circular shapes of triangular or hexagonal, the triangular shape has the triangular opposing and parallel main plane, the hexagonal surface has the hexagonal one, and the circular shape has the circular one.

The aspect ratio of the tabular grain is a value obtained by dividing the grain diameter by the thickness. The measurement of thickness of the tabular grain can be easily carried out by depositing a metal from the oblique direction of the grain together with a latex for reference, measuring the length of its shadow on an electron microscope photograph and calculating referring to the length of shadow of the latex.

The grain diameter of the invention is the diameter of a circle having an area equal to the projected area of the parallel main planes of the grain.

The projected area of the grain is obtained by measuring an area on the electron microscope photograph and compensating a photographing magnification.

The diameter of the tabular grain is preferably 0.3 to 5.0 $\mu$m. The thickness of the tabular grain is preferably 0.05 to 0.5 $\mu$m.

The sum of the projected areas of the tabular grains used in the present invention preferably occupies 50% or more, more preferably 80% or more, of the total projected area of all the silver halide grains in the emulsion. Further, the aspect ratios of the tabular grains which occupy these fixed areas are preferably 1.5 to less than 100, more preferably 2 to less than 20, and further preferably 2 to less than 8.

Further, when monodisperse tabular grains are used, further preferable effect happens to be obtained. The structure and preparation process of the monodisperse tabular grains are according to, for example, JP-A-63-151618 and the like, and when its shape is simply described, 70% or more of all the projected areas of silver halide grains is a hexagonal shape in which a ratio of the length of a side having the maximum length to that of a side having the minimum length in the main plane is 2 or less, and is occupied by the tabular silver halide grains having two parallel planes as outer planes. Further, it has the monodisperse property in which the variation coefficient of the grain diameter distribution of said hexagonal tabular silver halide grain, i.e., a value obtained by dividing the deviation (standard deviation) of grain diameters by the average grain diameter and then multiply with 100, is 20% or less.

In the present invention, the tabular grains preferably have dislocation lines.

The dislocation in the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Tech. Japan, 35, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines in each grain viewed in the direction perpendicular to the main planes.

The position of the dislocation of the tabular grains used in the present invention arises from x % of the distance between the center and the side to the side, along the long axis of the tabular grain. The value x is preferably $10 \leqq x < 100$, more preferably $30 \leqq x < 98$, and much more preferably $50 \leqq x < 95$. In this instance, the figure created by binding the positions from which the dislocation lines start is nearly similar to the configuration of the grain. The created figure may be one that is not a complete similar figure but deviated. The direction of the dislocation lines is roughly in the direction from the center to the sides, but they often windle.

Regarding the number of dislocation lines in the tabular grains used in the present invention, it is preferable that grains having 10 or more dislocation lines are present in an amount of 50% (by number of grains) or more. More preferably, grains having 10 or more dislocation lines are present in an amount of 80% (by number of grains) or more, and especially preferably those having 20 or more dislocation lines in an amount of 80% (by number of grains) or more.

The preparation process of the tabular grain used in the present invention is described.

The tabular grain used in the present invention can be prepared by improving methods described in "Cleave, Photography Theory and Practice (1930), page 13", "Gutuff, Photographic Science and Engineering Vol.14, pages 248-257 (1970)", U.S. Pat. Nos. 4,434,226, 4,414,310, 4,433,048 and 4,439,520, and BG 2,112,157 and the like.

Any of the silver halide compositions such as silver bromide, silver iodobromide, silver iodochlorobromide and silver chlorobromide may be used for the tabular silver halide grain used in the present invention. The preferable silver halide composition is silver iodobromide or silver iodochlorobromide containing 30 mol % or less of silver iodide.

The silver halide grains used in the present invention may have a multiple structure of a double structure or more, for example, a quintuple structure, concerning the intra-grain silver halide composition. The structure refers to a structure concerning the intra-grain silver iodide distribution, and it is indicated that the difference in silver iodide content between each structure is of 1 mol % or more. This intra-grain silver iodide distribution structure can be basically obtained by calculations from the prescribed value in the grain preparation step. In the interface between layers of the structure, the silver iodide content can change either abruptly or moderately. The EPMA (Electron Probe Micro Analyzer) method is usually effective to confirm this structure, although the measurement accuracy of analysis must be taken into consideration. By forming a sample in which emulsion grains are dispersed so as not to contact each other and analyzing radiated X-rays by radiating an electron beam, elements in a micro region irradiated with the electron beam can be analyzed. The measurement is preferably performed under cooling at low temperatures in order to prevent damage to the sample by the electron beam. By this method, the intra-grain silver iodide distribution of a tabular grain can be analyzed when the grain is viewed in a direction perpendicular to its main planes. Additionally, when a specimen obtained by hardening a sample and cutting the sample into a very thin piece using microtome is used, the intra-grain silver iodide distribution in the section of a tabular grain can be analyzed.

In the nucleation of the grain formation, to use a gelatin having a small methionine content disclosed in U.S. Pat. Nos. 4,713,320 and 4,942,120; to perform the nucleation at a high pBr disclosed in U.S. Pat. No. 4,914,014; and to perform the nucleation in a short time disclosed in JP-A-2-222940 are very effective for the preparation of tabular grains. In the ripening step, to perform the ripening in the presence of a base of a low concentration disclosed in U.S. Pat. No. 5,254,453 and to perform the ripening at a high pH disclosed in U.S. Pat. No. 5,013,641 may be effective for the ripening step of the emulsions of the invention.

The method of forming tabular grains using the polyalkyleneoxide compounds described in U.S. Pat. Nos. 5,147,771, 5,147,772, 5,147,773, 5,171,659, 5,210,013, and 5,252,453, is preferably used in the core grain preparation used in the present invention.

To obtain high-aspect-ratio monodisperse tabular grains, gelatin is sometimes additionally added during grain formation. The gelatin used at that time is preferably chemically modified gelatin described in JP-A's-10-148897 and 11-143002 or gelatin having a small methionine content described in U.S. Pat. Nos. 4,713,320 and 4,942,120. The former chemically modified gelatin is a gelatin characterized in that at least two carboxyl groups are newly introduced when an amino group in the gelatin is chemically modified. It is preferable to use succinated gelatin or trimellitated gelatin. This chemically modified gelatin is added preferably before the growth step, and more preferably immediately after nucleation. The addition amount thereof is 50% or more, preferably 70% or more of the weight of the total dispersing medium used during grain formation.

Examples of silver halide solvents which can be used in the present invention include organic thioethers (a) described in U.S. Pat. Nos. 3,271,157, 3,531,286 and 3,574,628 and JP-A's-54-1019 and 54-158917; thiourea derivatives (b) described in JP-A's-53-82408, 55-77737 and 55-2982; silver halide solvents having a thiocarbonyl group interposed between an oxygen or sulfur atom and a nitrogen atom (c) described in JP-A-53-144319; imidazoles (d) described in JP-A-54-100717; sulfites (e); ammonia (f); and thiocyanates (g). Especially preferred solvents are thiocyanates, ammonia and tetramethylthiourea. Although the amount of added solvent depends on the type thereof, in the case of, for example, a thiocyanate, the preferred amount is in the range of $1\times10^{-4}$ to $1\times10^{-2}$ mol per mol of silver halides. Basically, when a washing step is provided after the first shell formation as described above, the solvent can be removed regardless of the kind of a solvent used.

The dislocation of the tabular grain used in the present invention is introduced by providing a high iodine phase to the inside of the grain.

The high iodine phase is a silver halide solid solution containing iodine, and in this case, silver iodide, silver iodobromide and silver chloroiodobromide are preferable as the silver halide, silver iodide or silver iodobromide is preferable and silver iodide is preferable in particular.

The amount of silver halide which forms the high-iodide phase is 30 mol % or less of the silver amount of all the grains, and further preferably 10 mol % or less.

A phase grown at the outside of the high iodine phase is required to have a lower silver iodide contents than that in the high iodine phase, and the preferable silver iodide content is 0 to 12 mol %, further preferably 0 to 6 mol %, and most preferably 0 to 3 mol %.

As the preferable method of forming the high iodine phase, there is a method of forming the phase by adding an emulsion containing silver iodobromide or a silver iodide fine grains (hereinafter referred to as silver iodide fine grain emulsion). Fine grains preliminarily prepared can be used as these fine grains, and the fine grains immediately after preparation can be more preferably used.

A case of using the fine grains preliminarily prepared is firstly illustrated. In this case, there is a method of adding the fine grains preliminarily prepared, ripening and dissolving them. As the more preferable method, there is a method of adding the silver iodide fine grain emulsion, and then adding an aqueous silver nitrate solution, or an aqueous silver nitrate solution and an aqueous halogen solution. In this case, the dissolution of the fine grains is accelerated by the addition of the aqueous silver nitrate solution. It is preferred that the silver iodide fine grain emulsion be added abruptly.

The abrupt addition of the silver iodide fine grain emulsion means the addition of the silver iodide fine grain emulsion within preferably 10 minutes. It means the addition within 7 minutes more preferably. The condition can be changed according to the temperature, pBr and pH of a system added, the kind and concentration of protective colloid agents such as a gelatin and the like, the presence or absence, kind, and concentration of the silver halide solvent, and the like, but the shorter period is preferable as described above. It is preferable that the addition of an aqueous silver salt solution such as silver nitrate or the like is not substantially carried out at the addition. The temperature of the system at the addition is preferably 40° C. or more and 90° C. or less, and preferably 50° C. or more and 80° C. or less in particular.

The composition of fine grains contained in the silver iodide fine grain emulsion may be substantially silver iodide, and silver bromide and/or silver chloride may be contained so far as it can be a mix crystal. Preferable is 100% silver iodide. Silver iodide occasionally takes a β-form, a γ-form and an α-form or an α-form analogous structure as described in U.S. Pat. No. 4,672,026, in its crystal structure. In the present invention, there is no limitation of the crystal structure in particular, a mixture of the β-form and the γ-form is used, and the β-form is further preferably used. The silver iodide fine grain emulsion after a usual washing step with water is preferably used. The silver iodide fine grain emulsion can be easily formed by a method described in U.S. Pat. No. 4,672,026. The grain formation is carried out by making the pI value at the grain formation constant. The double jet addition method of the aqueous silver salt solution and the aqueous iodide salt solution is preferable. Herein, pI is a logarithm of the reciprocal of $I^-$ ion concentration of the system. The temperature, pI, pH, the kind and concentration of protective colloid agents such as a gelatin and the like, the presence or absence, kind, and concentration of the silver halide solvent, and the like are not limited in particular, but it is suitable for the present invention that the size of grains is 0.1 μm or less and more preferably 0.07 μm or less. Since the grains are fine grains, the grain shape is not perfectly specified, but the variation coefficient of the grain size distribution is preferably 25% or less. When it is 20 or less, the advantage of the invention is remarkable. Herein, the size and the size distribution of the fine grains are directly determined by putting the fine grains on a mesh for electron microscope observation, and observing by not a carbon replica method but a permeation method. Since the grain size is small, measurement error becomes great by observation according to the carbon replica method. The grain size is defined as the diameter of a circle having a projected area equal to the grain observed. The size distribution of grains is also determined using the circle diameter having the equal projected area. The most effective fine grain in the present invention is that having a grain size of 0.06 μm or less and 0.02 μm or more, and the variation coefficient of a size distribution of grains of 18% or less.

In the formation of the silver iodide fine grain emulsion, after the above-mentioned grain formation, a usual washing with water described in U.S. Pat. No. 2,614,929 is preferably carried out to the silver iodide fine grain emulsion, and pH, pI, the concentration of protective colloid agents such as a gelatin and the like and the concentration of the silver iodide contained are carried out. The pH is preferably 5 or more and 7 or less. The pI value is preferably set at a pI value in which the solubility of silver iodide is minimum, or at a higher pI value than the value. As the protective agent, a usual gelatin having an average molecular weight of about 100,000 is preferably used. A low-molecular-weight gelatin having an average molecular weight of 20,000 or less is also preferably used. Further, there is occasionally a suitable case if the above-mentioned gelatins having different molecular weights are used in mixture. The amount of the gelatin per one kg of the emulsion is preferably 10 g or more and 100 g or less. 20 g or more and 80 g or less is more preferable. The amount of silver converted to silver atom per kg of the emulsion is preferably 10 g or more and 100 g or less. 20 g or more and 80 g or less is more preferable. As the amount of the gelatin and/or the amount of silver, a value suitable for abruptly adding the silver iodide fine grain emulsion is preferably selected.

The silver iodide fine grain emulsion is usually added by preliminarily being dissolved, and the stirring efficiency of the system at addition is required to be adequately enhanced. The rotational number of stirring is preferably set higher than usual. The addition of a defoaming agent is effective for preventing the generation of foam at stirring. Specifically, a defoaming agent described in Examples and the like of U.S. Pat. No. 5,275,929 is used.

When the fine grains immediately after preparation is used, a detail concerning a mixer for forming the silver halide fine grain can be referred to the description of JP-A-10-43570.

For the silver halide fine grains of the invention, it is preferable that the variation coefficient of the silver iodide contents distribution is 20% or less. 15% or less is preferable, and 10% or less is preferable in particular. When the variation coefficient is more than 20%, it does not have high contrast, and when a pressure is applied, it is not preferable because the decrease of sensitivity becomes also great. The silver iodide content of each grain can be measured by analyzing the composition of each of grains using an X-ray micro analyzer. The variation coefficient of the silver iodide content distribution between the respective grains is a value determined by the relation equation (standard deviation/average silver iodide content)×100= variation coefficient using the standard deviation of the silver iodide content and the average silver iodide content when the silver iodide content of at least 100 or more, more preferably 200 or more and in particular preferably 300 or more of the emulsion grains is measured. The measurement of the silver iodide contents of individual grains is described in, for example, EP 147,868. There is a correlation or no correlation between the silver iodide content Yi (mol) of the individual grains and the equivalent-sphere diameter Xi (μm) of the respective grains, but no correlation is desirable.

The silver halide emulsion of the invention is preferably provided with a positive hole-capturing zone in at least a portion of the inside of the silver halide grains. The positive hole-capturing zone of the invention indicates a region having a function of capturing a positive hole generated in pair with photo-electron generated by, for example, photo-excitation. Such positive hole-capturing zone is defined in the present invention as a zone provided by an intentional reduction sensitization.

The intentional reduction sensitization in the present invention means an operation of introducing a positive hole-capturing silver nuclei into a portion or all of the inside of the silver halide grains by adding a reduction sensitizing agent. The positive hole-capturing silver nuclei means a small silver nuclei having a little development activity, and the recombination loss at a lightsensitive process is prevented by the silver nuclei and the sensitivity can be enhanced.

Examples of known reduction sensitizers include stannous salts, ascorbic acid and derivatives thereof, amines and polyamines, hydrazine derivatives, formamidinesulfinic acid, silane compounds and borane compounds. In the reduction sensitization employed in the present invention, appropriate one may be selected from among these known reduction sensitizers and used or at least two may be selected and used in combination. Preferred reduction sensitizers are stannous chloride, thiourea dioxide, dimethylaminoborane, ascorbic acid and derivatives thereof. Although the addition amount of reduction sensitizer must be selected because it depends on the emulsion manufacturing conditions, it is preferred that the addition amount range from $10^{-7}$ to $10^{-3}$ mol per mol of silver halide.

The reduction sensitizer is dissolved in water or any of organic solvents such as alcohols, glycols, ketones, esters and amides and added during the grain growth.

In the present invention, the positive hole-capturing silver nuclei is formed preferably by adding a reduction sensitizer at a time of after nucleation and after the completion of the physical ripening, and immediately before the initiation of grain formation. However, the positive hole-capturing silver nuclei can also be introduce on the grain surface by adding a reduction sensitizer on and after the completion of the grain formation.

When a reduction sensitizer is added during grain formation, some silver nuclei formed can stay inside a grain, but some ooze out to form silver nuclei on the grain surface. In the present invention, these oozing silver nuclei are preferably used as positive hole-capturing silver nuclei.

In the present invention, when the intentional reduction sensitization is performed during a step in the midst of grain growth in order to form the positive hole-capturing nuclei inside the silver halide grain, it is necessary to perform the intentional reduction sensitization in the presence of a compound represented by general formula (I-1) or general formula (I-2).

Herein, the step in the midst of the grain growth does not include the step after the final desalting is performed. For example, a step of chemical sensitization in which silver halide grains grow as a result of the addition of a silver salt solution and fine grain silver halide, is not included.

(I-1)

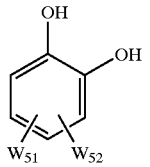

(I-2)

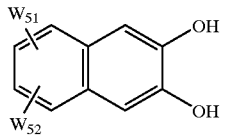

In formulas (I-1) and (I-2), each of $W_{51}$ and $W_{52}$ independently represents a sulfo group or hydrogen atom. However, at least one of $W_{51}$ and $W_{52}$ represents a sulfo group. A sulfo group is generally an alkali metal salt such as sodium or potassium or a water-soluble salt such as ammonium salt. Favorable practical examples are 3,5-disulfocatechol disodium salt, 4-sulfocatechol ammonium salt, 2,3-dihydroxy-7-sulfonaphthalene sodium salt, and 2,3-dihydroxy-6,7-jisulfonaphthalen potassium salt. A preferred addition amount can vary in accordance with, e.g., the temperature, pBr, and pH of the system to which the compound is added, the type and concentration of a protective colloid agent such as gelatin, and the presence/absence, type, and concentration of a silver halide solvent. Generally, the addition amount is preferably 0.0005 to 0.5 mol, and more preferably, 0.003 to 0.02 mol per mol of a silver halide.

An oxidizer capable of oxidizing silver is preferably used during the process of producing the emulsion for use in the present invention (hereinafter also referred to as the emulsion of the invention). The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].\ 6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen-releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones. Especially preferably, the oxidizers are thisosulfonate such as those described in JP-A-2-191938.

The addition of the oxidizer to silver may be performed at any time selected from before the initiation of the intentional reduction sensitization, during reduction sensitization, immediately before the termination of reduction sensitization and immediately after the termination of reduction sensitization. The addition of the oxidizer to silver may be performed several times separately. The addition amount, although it varies depending on a kind of the oxidizer, is preferably in a range of $1\times10^{-7}$ to $1\times10^{-3}$ mol per mol of silver halide.

It is advantageous to use gelatin as a protective colloid for use in preparation of emulsions of the invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; sugar derivatives, such as cellulose derivatives, e.g., cellulose sulfates, hydroxyethylcellulose, and carboxymethylcellulose, soda alginate, and starch derivatives; and a variety of synthetic hydrophilic high polymers, such as homopolymers or copolymers, e.g., polyvinyl alcohol, polyvinyl alcohol with partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan, 16, page 30 (1966). In addition, a hydrolyzed product or an enzyme-decomposed product of gelatin can also be used.

It is preferable to wash with water an emulsion of the present invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of the emulsion of the invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_4[Fe(CN)_6]$, $K_2IrCl_6$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In the silver halide grains used in the invention, at least one of chalcogen sensitization including sulfur sensitization and selenium sensitization, and noble metal sensitization including gold sensitization and palladium sensitization, and reduction sensitization can be performed at any point during the process of preparing a silver halide emulsion. The use of two or more different sensitizing methods is preferable.

Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization nucleus can be selected in accordance with the intended use. However, it is preferable to form at least one type of a chemical sensitization nucleus in the vicinity of the surface.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755.

In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide, or mesoionic gold compounds described in U.S. Pat. No. 5,220,030 and azole gold compounds described in U.S. Pat. No. 5,049,484 and so on. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

A preferable amount of a gold sensitizer used in the invention is $1\times10^{-3}$ to $1\times10^{-7}$ mol, and more preferably, $1\times10^{-4}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

A preferable amount of a sulfur sensitizer used in the invention is $1\times10^{-4}$ to $1\times10^{-7}$ mol, and more preferably, $1\times10^{-5}$ to $5\times10^{-7}$ mol per mol of a silver halide.

As a preferable,sensitizing method for the emulsion of the invention, selenium sensitization can be mentioned. As a selenium sensitize used in the invention, selenium compounds disclosed in hitherto published patents can be used as the selenium sensitizer in the present invention. In the use of labile selenium compound and/or nonlabile selenium compound, generally, it is added to an emulsion and the emulsion is agitated at high temperature, preferably 40° C. or above, for a given period of time. Compounds described in, for example, Jpn. Pat. Appln. KOKOKU Publication No. (hereinafter referred to as JP-B-) 44-15748, JP-B-43-13489, JP-A's-4-25832 and 4-109240 are preferably used as the unlabile selenium compound.

Specific examples of the labile selenium sensitizers include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacyl selenides (for example, bis(3-chloro-2, 6-dimethoxybenzoyl) selenide), selenophosphates, phosphine selenides and colloidal metal selenium.

The labile selenium compounds, although preferred types thereof are as mentioned above, are not limited thereto. It is generally understood by persons of ordinary skill in the art to which the invention pertains that the structure of the labile selenium compound as a photographic emulsion sensitizer is not so important as long as the selenium is labile and that the labile selenium compound plays no other role than having its selenium carried by organic portions of selenium sensitizer molecules and causing it to present in labile form in the emulsion. In the present invention, the labile selenium compounds of this broad concept can be used advantageously.

Compounds described in JP-B's-46-4553, 52-34492 and 52-34491 can be used as the nonlabile selenium compound used in the present invention. Examples of the nonlabile selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

These selenium sensitizers are dissolved in water or in a single solvent or a mixture of organic solvents selected from methanol and ethanol and added at the time of chemical sensitization. Preferably, the addition is performed prior to the initiation of chemical sensitization. The use of the above selenium sensitizers is not limited to a single kind, but the combined use of two or more kinds may be acceptable. The combined use of a labile selenium compound and an unlabile selenium compound is preferred.

The addition amount of the selenium sensitizer for use in the invention, although varied depending on the activity of employed selenium sensitizer, the type and size of silver halide, the ripening temperature and time, etc., is preferably in the range of $1\times10^{-8}$ or more. More preferably, the amount is $1\times10^{-7}$ mol or more and $5\times10^{-5}$ mol or less per mol of silver halide. The temperature of chemical ripening in the use of a selenium sensitizer is preferably 40° C. or more and 80° C. or less. The pAg and pH are arbitrary. For example, with respect to pH, the effect of the present invention can be exerted even if it widely ranges from 4 to 9.

Selenium sensitization is preferably used in combination with sulfur sensitization or noble metal sensitization or both of them. Further, in the present invention, a thiocyanic acid salt is preferably added in the silver halide emulsion at the chemical sensitization. As the thiocyanate, potassium thiocyanate, sodium thiocyanate, ammonium thiocyanate, and the like are used. It is usually added by being dissolved in an aqueous solution or a water-soluble solvent. The addition amount per mol of silver halide is $1\times10^{-5}$ mol to $1\times10^{-2}$ mol, and more preferably $5\times10^{-5}$ mol to $5\times10^{-3}$ mol.

It is preferred that in the silver halide emulsion of the present invention, an appropriate amount of calcium ion and/or a magnesium ion be contained. Thereby, the grain shape is made better, the quality of an image is improved, and the preservation property is made better. The range of the appropriate amount is 400 to 2500 ppm for calcium and/or 50 to 2500 ppm for magnesium, and calcium is more preferably 500 to 2000 ppm and magnesium is 200 to 2000 ppm. Herein, 400 to 2500 ppm for calcium and/or 50 to 2500 ppm for magnesium means that at least one of calcium and magnesium is a concentration within the range prescribed. When the content of calcium or magnesium is higher than these values, it is not preferable that inorganic salts which calcium salt, magnesium salt, a gelatin or the like has preliminarily retained precipitate and become the cause of trouble at the manufacture of the photographic material. Herein, the content of calcium or magnesium is represented by weight converted to calcium atom or magnesium atom for all of the compounds containing calcium or magnesium such as a calcium ion, a magnesium ion, a calcium salt, a magnesium salt and the like, and represented by concentration based on the unit weight of the emulsion.

The adjustment of the calcium content in the silver halide tabular emulsion of the invention is preferably carried out adding the calcium salt at the chemical sensitization. The gelatin generally used at manufacturing an emulsion contains already calcium by 100 to 4000 ppm as a solid gelatin, and calcium may be adjusted by adding a calcium salt to the gelatin to be increased. Further, if necessary, after carrying out the desalting (removal of calcium) from the gelatin according to a known method such as a washing method with water or an ion exchange method or the like, the content can be also adjusted by a calcium salt. As the calcium salt, calcium nitrate and calcium chloride are preferable, and calcium nitrate is most preferable. Similarly, the adjustment of the magnesium content can be carried out adding a magnesium salt. As the magnesium salt, magnesium nitrate, magnesium sulfate and magnesium chloride are preferable, and magnesium nitrate is most preferable. As the quantitative determination method of calcium or magnesium, it can be determined by ICP emission spectral analysis method. Calcium and magnesium may be used alone and a mixture of both may be used. It is more preferable to contain calcium. The addition of calcium or magnesium can be carried out at the arbitrary period of the manufacturing steps of the silver halide emulsion, but is preferably from after the grain formation to just after completion of the spectral sensitization and the chemical sensitization, and more preferably after addition of a sensitizing dye. Further, it is preferable in particular to add after addition of a sensitizing dye and before carrying out the chemical sensitization.

As a particularly effective compound for reducing the fog of the silver halide emulsion and suppressing the increase of the fog during preservation, a mercaptotetrazol compound having a water-soluble group described in JP-A-4-16838 is mentioned. Further, in the JP-A above, it is disclosed that the preservation property is enhanced by using the mercaptotetrazol compound and a mercaptothiadiazol compound in combination.

The surface or an arbitrary position from the surface of the emulsion used in the present invention may be chemically sensitized, but it is preferable to chemically sensitize the surface. When the inner part is chemically sensitized, a method described in JP-A-63-264740 can be referred.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt; nitroimidazoles; nitrobenzimidazoles; chlorobenzimidazoles; bromobenzimidazoles; mercaptothiazoles; mercaptobenzothiazoles; mercaptobenzimidazoles; mercaptothiadiazoles; aminotriazoles; benzotriazoles; nitrobenzotriazoles; and mercaptotetrazoles (particularly 1-phenyl-5-mercaptotetrazole); mercaptopyrimidines; mercaptotriazines; a thioketo compound such as oxazolinethione; azaindenes such as triazaindenes, tetrazaindenes (particularly 4-hydroxy-substituted(1,3,3a,7) tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

The photographic emulsion for use in the present invention is preferably subjected to a spectral sensitization with a methine dye or the like to thereby exert the effects of the invention. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. These dyes may contain any of nuclei commonly used in cyanine dyes as basic heterocyclic nuclei. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

The merocyanine dye or composite merocyanine dye may have a 5 or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, and 3,837,862, 4,026,707, GB Nos. 1,344,281 and 1,507,803, JP-B's-43-4936 and 53-12375, and JP-A's-52-110618 and 52-109925.

The emulsion used in the present invention may contain a dye which itself exerts no spectral sensitizing effect or a substance which absorbs substantially none of visible radiation and exhibits supersensitization, together with the above spectral sensitizing dye.

The addition timing of the spectral sensitizing dye to the emulsion may be performed at any stage of the process for preparing the emulsion which is known as being useful. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

The addition thereof may be set from $4\times10^{-6}$ to $8\times10^{-3}$ mol per mol of silver halide.

The silver halide grain other than the tabular grain used in the photographic material of the present invention will be described below.

The preferable silver halide contained in the photographic emulsion layer of the photographic material of the present invention is silver iodobromide, silver iodochloride or silver iodochlorobromide containing about 30 mole or less of silver iodide. Silver iodobromide or silver iodochlorobromide containing about 1 mole to about 10 moll of silver iodide is preferable in particular.

The silver halide grains in the photographic emulsion may be those having a regular crystal such as cubic, octahedral and tetradecahedral; those having a regular crystal shape such as sphere and tabular; those having a crystal defect such as twin plane or the like, or a complex shape thereof.

The grain may be a fine grain having a grain seize of about 0.2 $\mu$m or less, and may be a large size grain having a projected area diameter up to about 10 $\mu$m. The emulsion containing the grains may be a polydisperse emulsion or a monodisperse emulsion.

The silver halide photographic emulsion which can be used in the present invention can be prepared by, for example, "Research Disclosure (RD) No. 17643 (December in 1978), page 22 to 23", "I. Emulsion Preparation and types", "ibid., No. 18716 (November in 1979), page 648", "ibid., No. 307105 (November in 1989), page 863 to 865", "Chemie et Phisique Photographique" authored by P. Glafkides and published by Paul Montel Co., Ltd. (1967), "Photographic Emulsion Chemistry" authored by G. F. Duffin and published by Forcal Press Co., Ltd. (1966), and "Making and Coating Photographic Emulsion" authored by V. L. Zelikman et al and published by Forcal Press Co., Ltd.

Monodisperse emulsions described in U.S. Pat. Nos. 3,574,628 and 3,655,394, and GB 1,413,748 are preferable.

The crystal structure may be a uniform one, a structure consisting of a halogen composition in which inner part is different from outer part, and a laminar structure. Further, silver halide having a different composition may be joined by epitaxial junction, and may be joined with a compound such as Rodin silver, lead oxide or the like other than silver halide. Further, a mixture of grains having various crystal shapes may be used.

The above-mentioned emulsion may be any one of a surface latent image type in which a latent image is mainly formed on a surface, an internal latent image type in which a latent image is formed in the inside of grains, and a type having latent images both on a surface and in the inside, but requires a negative emulsion. Among the internal latent image types, it may be a core/shell type internal latent image type emulsion described in JP-A-63-264740. The preparation method of the core/shell internal latent image type emulsion is described in JP-A-59-133542. The thickness of the shell of the emulsion differs according to development treatment and the like, but is preferably 3 to 40 nm and preferably 5 to 20 nm in particular.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in lightsensitive silver halide emulsion layers and/or essentially non-lightsensitive hydrophillic colloid layers. The internally fogged or surface-fogged silver halide grains means a silver halide grain which can be developed uniformly (non-imagewise) regardless of whether the location is a non-exposed or an exposed portion of the photosensitive material. A method of preparing the internally fogged or surface-fogged silver halide grain is described in U.S. Pat. No. 4,626,498 and JP-A-59-214852.

A silver halide which forms the core of an internally fogged core/shell type silver halide grain can have the same halogen composition or a different halogen composition. As the silver halide composition of the internally fogged or surface-fogged silver halide grains, any of silver chloride, silver chlorobromide, silver iodobromide and silver chloroiodobromide can be used. Although the grain size of these fogged silver halide grains is not particularly limited, the equivalent sphere diameter thereof is 0.01 to 0.75 μm, and especially preferably 0.05 to 0.6 μm. Further, the grain shape is not specifically limited, and can be a regular grain and a polydisperse emulsion. However, it is preferably a monodisperse, i.e., at least 95% in weight or number of silver halide grains thereof have grain sizes falling within the range of ±40% of the average equivalent sphere diameter).

In the photographic material of the present invention, 2 or more of emulsions having at least one of different properties of the grain size, grain size distribution, halogen composition, grain shape and sensitivity of the lightsensitive silver halide emulsion can be used in the same layer by mixing.

In the preparation method of the photographic material of the invention, photographically useful substances are usually added to a photographic coating solution, i.e., a hydrophilic colloidal solution.

In silver halide photosensitive emulsion of the invention and the silver halide photographic material in which the emulsion is used, it is generally possible to use various techniques and inorganic and organic materials described in Research Disclosure Nos. 308119 (1989), 37038 (1995), and 40145 (1997).

In addition, techniques and inorganic and organic materials usable in color photosensitive materials of the invention can be applied are described in portions of EP436,938A2 and patents cited below.

| | Items | Corresponding portions |
|---|---|---|
| 1) | Layer configurations | page 146, line 34 to page 147, line 25 |
| 2) | Silver halide emulsions usable together | page 147, line 26 to page 148 line 12 |
| 3) | Yellow couplers usable together | page 137, line 35 to page 146, line 33, and page 149, lines 21 to 23 |
| 4) | Magenta couplers usable together | page 149, lines 24 to 28; EP421, 453A1, page 3, line 5 to page 25, line 55 |
| 5) | Cyan couplers usable together | page 149, lines 29 to 33; EP432, 804A2, page 3, line 28 to page 40, line 2 |
| 6) | Polymer couplers | page 149, lines 34 to 38; EP435, 334A2, page 113, line 39 to page 123, line 37 |
| 7) | Colored couplers | page 53, line 42 to page 137, line 34, and page 149, lines 39 to 45 |
| 8) | Functional couplers usable together | page 7, line 1 to page 53, line 41, and page 149, line 46 to page 150, line 3; EP435, 334A2, page 3, line 1 To page 29, line 50 |
| 9) | Antiseptic and mildewproofing agents | page 150, lines 25 to 28 |
| 10) | Formalin scavengers | page 149, lines 15 to 17 |
| 11) | Other additives usable together | page 153, lines 38 to 47; EP421, 453A1, page 75, line 21 to page 84, line 56, and page 27, line 40 to page 37, line 40 |
| 12) | Dispersion methods | page 150, lines 4 to 24 |
| 13) | Supports | page 150, lines 32 to 34 |

-continued

| | Items | Corresponding portions |
|---|---|---|
| 14) | Film thickness · film physical properties | page 150, lines 35 to 49 |
| 15) | Color development step | page 150, line 50 to page 151, line 47 |
| 16) | Desilvering step | page 151, line 48 to page 152, line 53 |
| 17) | Automatic processor | page 152, line 54 to page 153, line 2 |
| 18) | Washing · stabilizing step | page 153, lines 3 to 37 |

When the photographic material of the invention is a color reversal material, image-forming method is provided thereto, in which the material is processed with an alkali developing solution containing a developer after it comes through an image-wise exposure and then black-and white development. After the color development, the color photographic material is processed with a processing solution having a bleaching ability in which a bleaching agent is contained.

EXAMPLES

The invention will be specifically described with reference to examples, but the invention is not limited to these.

Preparation of Sample 101

(1) Preparation of Triacetylcellulose Film

Triacetylcellulose was dissolved (13% by weight) by a common solution casting process in dichloromethane/methanol=92/8 (weight ratio), and triphenyl phosphate and biphenyldiphenyl phosphate in a weight ratio of 2:1, which are plasticizers, were added to the resultant solution so that the total amount of the plasticizers was 14% to the triacetylcellulose. Then, a triacetylcellulose film was made by a band process. The thickness of the support after drying was 97 μm.

(2) Components of Undercoat Layer

The two surfaces of the triacetylcellulose film were subjected to undercoating treatment. Numbers represent weight contained per 1 liter of an undercoat solution.

The two surfaces of the triacetylcellulose film were subjected to corona discharge treatment before undercoating treatment.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water to make | 1.0 L |

(3) Coating of Back Layers

One surface of the undercoated support was coated with the following back layers.

| 1st layer | |
|---|---|
| Binder: acid-processed gelatin (isoelectric point: 9.0) | 1.10 g |
| Polymeric latex: P-2 (average grain size: 0.1 μm) | 0.13 g |

-continued

| | |
|---|---|
| Polymeric latex: P-3 (average grain size: 0.2 μm) | 0.23 g |
| Ultraviolet absorbent U-1 | 0.030 g |
| Ultraviolet absorbent U-3 | 0.010 g |
| Ultraviolet absorbant U-4 | 0.020 g |
| High-boiling organic solvent Oil-2 | 0.030 g |
| Surfactant W-3 | 0.010 g |
| Surfactant W-6 | 3.0 mg |
| **2nd layer** | |
| Binder: acid-processed gelatin (isoelectric point: 9.0) | 3.30 g |
| Polymeric latex: P-3 (average grain size: 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| **3rd layer** | |
| Binder: acid-processed gelatin (isoelectric point: 9.0) | 3.50 g |
| Surfactant W-3 | 0.020 g |
| Potassium sulfate | 0.30 g |
| Sodium hydroxide | 0.03 g |
| **4th layer** | |
| Binder: lime-processed gelatin (isoelectric point: 5.4) | 1.25 g |
| 1:9 copolymer of methacrylic acid and methylmethacrylate (average grain size: 2.0 μm) | 0.040 g |
| 6:4 copolymer of methacrylic acid and methylmethacrylate (average grain size: 2.0 μm) | 0.030 g |
| Surfactant W-3 | 0.060 g |
| Surfactant W-2 | 7.0 mg |
| Hardener H-1 | 0.23 g |

(4) Coating of Photosensitive Emulsion Layers

Sample 101 was made by coating photosensitive emulsion layers presented below on the side opposite, against the support, to the side having the back layers. Numbers represent addition amounts per $m^2$ of the coating surface. Note that the effects of added compounds are not restricted to the described purposes.

| | | |
|---|---|---|
| **1st layer: Antihalation layer** | | |
| Black colloidal silver | | 0.25 g |
| Gelatin | | 2.10 g |
| Ultraviolet absorbent U-1 | | 0.15 g |
| Ultraviolet absorbent U-3 | | 0.15 g |
| Ultraviolet absorbent U-4 | | 0.10 g |
| High-boiling organic solvent Oil-1 | | 0.10 g |
| High-boiling organic solvent Oil-2 | | 0.10 g |
| High-boiling organic solvent Oil-5 | | 0.010 g |
| Dye D-4 | | 1.0 mg |
| Dye D-8 | | 2.5 mg |
| Fine crystal solid dispersion of dye E-1 | | 0.05 g |
| **2nd layer: Interlayer** | | |
| Gelatin | | 0.50 g |
| Compound Cpd-R | | 0.050 g |
| Compound Cpd-S | | 0.025 g |
| High-boiling organic solvent Oil-4 | | 0.010 g |
| High-boiling organic solvent Oil-7 | | 2.0 mg |
| Dye D-7 | | 4.0 mg |

-continued

| | | |
|---|---|---|
| **3rd layer: Short wavelength green-sensitive emulsion layer** | | |
| Emulsion R | silver | 0.30 g |
| Emulsion S | silver | 0.30 g |
| Gelatin | | 0.45 g |
| **4th layer: 2nd interlayer** | | |
| Gelatin | | 0.60 g |
| Compound Cpd-D | | 0.020 g |
| Compound Cpd-M | | 0.320 g |
| Compound Cpd-R | | 0.050 g |
| Compound Cpd-S | | 0.025 g |
| High-boiling organic solvent Oil-3 | | 0.010 g |
| High-boiling organic solvent Oil-10 | | 0.250 g |
| **5th layer: Low-speed red-sensitive emulsion layer** | | |
| Emulsion A | silver | 0.10 g |
| Emulsion B | silver | 0.15 g |
| Emulsion C | silver | 0.15 g |
| Silver iodobromide emulsion whose surface and interior are previously fogged (cubic, average silver iodide content: 1 mol %, equivalent sphere average grain size: 0.06 μm) | silver | 0.01 g |
| Gelatin | | 0.70 g |
| Coupler C-1 | | 0.15 g |
| Coupler C-2 | | 7.0 mg |
| Coupler C-10 | | 3.0 mg |
| Coupler C-11 | | 2.0 mg |
| Ultraviolet absorbent U-3 | | 0.010 g |
| Compound Cpd-I | | 0.020 g |
| Compound Cpd-D | | 3.0 mg |
| Compound Cpd-J | | 2.0 mg |
| Compound Cpd-K | | 3.0 mg |
| High-boiling organic solvent Oil-10 | | 0.030 g |
| Additive P-1 | | 5.0 mg |
| **6th layer: Medium-speed red-sensitive emulsion layer** | | |
| Emulsion C | silver | 0.15 g |
| Emulsion D | silver | 0.15 g |
| Gelatin | | 0.70 g |
| Coupler C-1 | | 0.15 g |
| Coupler C-2 | | 7.0 mg |
| Coupler C-10 | | 3.0 mg |
| Compound Cpd-D | | 3.0 mg |
| Ultraviolet absorbent U-3 | | 0.010 g |
| High-boiling organic solvent Oil-10 | | 0.030 g |
| Additive P-1 | | 7.0 mg |
| **7th layer: High-speed red-sensitive emulsion layer** | | |
| Emulsion E | silver | 0.15 g |
| Emulsion F | silver | 0.20 g |
| Gelatin | | 1.30 g |
| Coupler C-1 | | 0.60 g |
| Coupler C-2 | | 0.015 g |
| Coupler C-3 | | 0.030 g |
| Coupler C-10 | | 5.0 mg |
| Ultraviolet absorbent U-1 | | 0.010 g |
| Ultraviolet absorbent U-2 | | 0.010 g |
| High-boiling organic solvent Oil-6 | | 0.030 g |
| High-boiling organic solvent Oil-9 | | 0.020 g |
| High-boiling organic solvent Oil-10 | | 0.050 g |
| Compound Cpd-D | | 5.0 mg |
| Compound Cpd-K | | 1.0 mg |
| Compound Cpd-F | | 0.030 g |
| Additive P-1 | | 0.010 g |
| Additive P-4 | | 0.030 g |
| **8th layer: Interlayer** | | |
| Gelatin | | 1.40 g |
| Additive P-2 | | 0.15 g |
| Dye D-5 | | 0.020 g |
| Dye D-9 | | 6.0 mg |
| Compound Cpd-A | | 0.050 g |
| Compound Cpd-D | | 0.030 g |
| Compound Cpd-I | | 0.010 g |

-continued

| | | |
|---|---|---|
| Compound Cpd-M | | 0.090 g |
| Compound Cpd-O | | 3.0 mg |
| Compound Cpd-P | | 5.0 mg |
| High-boiling organic solvent Oil-6 | | 0.100 g |
| High-boiling organic solvent Oil-3 | | 0.010 g |
| Ultraviolet absorbent U-1 | | 0.010 g |
| Ultraviolet absorbent U-3 | | 0.010 g |
| 9th layer: Low-speed green-sensitive emulsion layer | | |
| Emulsion G | silver | 0.25 g |
| Emulsion H | silver | 0.30 g |
| Emulsion I | silver | 0.25 g |
| Silver iodobromide emulsion whose surface and interior are previously fogged (cubic, average silver iodide content: 1 mol %, equivalent sphere average grain size: 0.06 μm) | silver | 0.010 g |
| Gelatin | | 1.30 g |
| Coupler C-4 | | 0.20 g |
| Coupler C-5 | | 0.050 g |
| Coupler C-6 | | 0.020 g |
| Compound Cpd-A | | 5.0 mg |
| Compound Cpd-B | | 0.030 g |
| Compound Cpd-D | | 5.0 mg |
| Compound Cpd-F | | 0.010 g |
| Compound Cpd-G | | 2.5 mg |
| Compound Cpd-K | | 1.0 mg |
| Ultraviolet absorbent U-6 | | 5.0 mg |
| High-boiling organic solvent Oil-2 | | 0.25 g |
| Additive P-1 | | 5.0 mg |
| 10th layer: Medium-speed green-sensitive emulsion layer | | |
| Emulsion I | silver | 0.30 g |
| Emulsion J | silver | 0.30 g |
| Gelatin | | 0.70 g |
| Coupler C-4 | | 0.25 g |
| Coupler C-5 | | 0.050 g |
| Coupler C-6 | | 0.020 g |
| Compound Cpd-A | | 5.0 mg |
| Compound Cpd-B | | 0.030 g |
| Compound Cpd-F | | 0.010 g |
| Compound Cpd-G | | 2.0 mg |
| High-boiling organic solvent Oil-2 | | 0.20 g |
| High-boiling organic solvent Oil-9 | | 0.050 g |
| 11th layer: High-speed green-sensitive emulsion layer | | |
| Emulsion K | silver | 0.40 g |
| Gelatin | | 0.80 g |
| Coupler C-4 | | 0.30 g |
| Coupler C-5 | | 0.080 g |
| Coupler C-7 | | 0.050 g |
| Compound Cpd-A | | 5.0 mg |
| Compound Cpd-B | | 0.030 g |
| Compound Cpd-F | | 0.010 g |
| High-boiling organic solvent Oil-2 | | 0.20 g |
| High-boiling organic solvent Oil-9 | | 0.050 g |
| 12th layer: Yellow filter layer | | |
| Gelatin | | 1.0 g |
| Compound Cpd-C | | 0.010 g |
| Compound Cpd-M | | 0.10 g |
| High-boiling organic solvent Oil-1 | | 0.020 g |
| High-boiling organic solvent Oil-6 | | 0.10 g |
| Fine crystal solid dispersion of dye E-2 | | 0.25 g |
| 13th layer: Short wavelength blue-sensitive emulsion layer | | |
| Emulsion T | silver | 0.27 g |
| Gelatin | | 0.40 g |
| Compound Cpd-Q | | 0.20 g |
| 14th layer: Low-speed blue-sensitive emulsion layer | | |
| Emulsion L | silver | 0.15 g |
| Emulsion M | silver | 0.20 g |
| Emulsion N | silver | 0.10 g |
| Silver bromide emulsion whose interior is previously fogged | silver | 3.0 mg |

-continued

| | | |
|---|---|---|
| (cubic, equivalent sphere average grain size: 0.11 μm) | | |
| Gelatin | | 0.80 g |
| Coupler C-8 | | 0.020 g |
| Coupler C-9 | | 0.30 g |
| Coupler C-10 | | 5.0 mg |
| Compound Cpd-B | | 0.10 g |
| Compound Cpd-I | | 8.0 mg |
| Compound Cpd-K | | 1.0 mg |
| Compound Cpd-M | | 0.010 g |
| Ultraviolet absorbent U-6 | | 0.010 g |
| High-boiling organic solvent Oil-2 | | 0.010 g |
| 15th layer: Medium-speed blue-sensitive emulsion layer | | |
| Emulsion N | silver | 0.20 g |
| Emulsion O | silver | 0.20 g |
| Gelatin | | 0.80 g |
| Coupler C-8 | | 0.020 g |
| Coupler C-9 | | 0.25 g |
| Coupler C-10 | | 0.010 g |
| Compound Cpd-B | | 0.10 g |
| Compound Cpd-N | | 2.0 mg |
| High-boiling organic solvent Oil-2 | | 0.010 g |
| 16th layer: High-speed blue-sensitive emulsion layer | | |
| Emulsion P | silver | 0.20 g |
| Emulsion Q | silver | 0.25 g |
| Gelatin | | 2.00 g |
| Coupler C-1 | | 2.0 mg |
| Coupler C-3 | | 5.0 mg |
| Coupler C-8 | | 0.10 g |
| Coupler C-9 | | 1.00 g |
| Coupler C-10 | | 0.020 g |
| High-boiling organic solvent Oil-2 | | 0.10 g |
| High-boiling organic solvent Oil-3 | | 0.020 g |
| Ultraviolet absorbent U-6 | | 0.10 g |
| Compound Cpd-B | | 0.20 g |
| Compound Cpd-N | | 5.0 mg |
| 17th layer: 1st protective layer | | |
| Gelatin | | 1.00 g |
| Ultraviolet absorbent U-1 | | 0.15 g |
| Ultraviolet absorbent U-2 | | 0.050 g |
| Ultraviolet absorbent U-5 | | 0.20 g |
| Compound Cpd-O | | 5.0 mg |
| Compound Cpd-A | | 0.030 g |
| Compound Cpd-H | | 0.20 g |
| Dye D-1 | | 8.0 mg |
| Dye D-2 | | 0.010 g |
| Dye D-3 | | 0.010 g |
| High-boiling organic solvent Oil-3 | | 0.10 g |
| 18th layer: 2nd protective layer | | |
| Colloidal silver | silver | 2.5 mg |
| Fine grain silver iodobromide emulsion (average silver iodide content: 1 mol %, equivalent sphere average grain diameter 0.06 μm) | silver | 0.10 g |
| Gelatin | | 0.80 g |
| Compound Cpd-T | | 0.24 g |
| Ultraviolet absorbent U-1 | | 0.030 g |
| Ultraviolet absorbent U-6 | | 0.030 g |
| High-boiling organic solvent Oil-3 | | 0.010 g |
| 19th layer: 3rd protective layer | | |
| Gelatin | | 1.00 g |
| Polymethylmethacrylate (average grain size 1.5 μm) | | 0.10 g |
| 6:4 copolymer of methylmethacrylate and methacrylic acid (average grain size 1.5 μm) | | 0.15 g |
| Silicone oil SO-1 | | 0.20 g |
| Surfactant W-1 | | 3.0 mg |
| Surfactant W-2 | | 8.0 mg |
| Surfactant W-3 | | 0.040 g |
| Surfactant W-7 | | 0.015 g |

In addition to the above compositions, additives F-1 to F-9 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

TABLE 1

Silver halide emulsions used in Sample 101

| Emulsion | Characteristics | Av. ESD (μm) | COV (%) | Av. AgI content (mol %) | Structure in halide composition of silver halide grains | AgI content at grain surface (mol %) | Other characterisitics (1) | (2) | (3) | (4) | (5) |
|---|---|---|---|---|---|---|---|---|---|---|---|
| A | Monodispersed tetradecahedral grains | 0.24 | 9 | 3.5 | Triple structure | 1.5 | | ○ | | | |
| B | Monodispersed (111) tabular grains Av. aspect ratio 4.0 | 0.25 | 10 | 3.5 | Quadruple structure | 1.5 | ○ | | ○ | ○ | ○ |
| C | Monodispersed (111) tabular grains Av. aspect ratio 5.0 | 0.30 | 19 | 3.0 | Triple structure | 0.1 | ○ | ○ | | ○ | ○ |
| D | Monodispersed (111) tabular grains Av. aspect ratio 6.0 | 0.35 | 21 | 4.8 | Triple structure | 2.0 | ○ | ○ | | ○ | ○ |
| E | Monodispersed (111) tabular grains Av. aspect ratio 6.0 | 0.40 | 10 | 2.0 | Quadruple structure | 1.5 | | ○ | | | |
| F | Monodispersed (111) tabular grains Av. aspect ratio 8.0 | 0.55 | 12 | 1.6 | Triple structure | 0.6 | ○ | ○ | | | ○ |
| G | Monodispersed cubic grains | 0.15 | 9 | 3.5 | Quadruple structure | 2.0 | | | ○ | | |
| H | Monodispersed cubic grains | 0.24 | 12 | 4.9 | Quadruple structure | 0.1 | ○ | ○ | | ○ | |
| I | Monodispersed (111) tabular grains Av. aspect ratio 6.0 | 0.30 | 12 | 3.5 | Quintuple structure | 4.5 | ○ | ○ | | ○ | ○ |
| J | Monodispersed (111) tabular grains Av. aspect ratio 8.0 | 0.45 | 21 | 3.0 | Quadruple structure | 0.2 | ○ | ○ | | ○ | ○ |
| K | Monodispersed (111) tabular grains Av. aspect ratio 12.0 | 0.60 | 13 | 2.7 | Triple structure | 1.3 | ○ | ○ | | | ○ |
| L | Monodispersed-tetradechaedral grains | 0.31 | 9 | 3.5 | Triple structure | 7.0 | | | ○ | | ○ |
| M | Monodispersed-tetradecahedral grains | 0.31 | 9 | 3.5 | Triple structure | 5.0 | ○ | ○ | | ○ | ○ |
| N | Monodispersed (111) tabular grains Av. aspect ratio 5.0 | 0.33 | 13 | 2.1 | Quadruple structure | 4.0 | ○ | ○ | ○ | | |
| O | Monodispersed (111) tabular grains Av. aspect ratio 6.0 | 0.43 | 9 | 2.5 | Quadruple structure | 1.0 | ○ | ○ | | ○ | ○ |
| P | Monodispersed (111) tabular grains Av. aspect ratio 6.0 | 0.75 | 21 | 2.8 | Triple structure | 0.5 | ○ | ○ | | | ○ |
| Q | Monodispersed (111) tabular grains Av. aspect ratio 10.0 | 0.90 | 8 | 1.0 | Quadruple structure | 0.5 | ○ | ○ | | | ○ |
| R | Monodispersed (111) tabular grains Av. aspect ratio 6.6 | 0.90 | 10 | 9.0 | Quadruple structure | 3.0 | ○ | ○ | | | ○ |
| S | Monodispersed (111) tabular grains Av. aspect ratio 5.0 | 0.50 | 8 | 11.0 | Quadruple structure | 4.0 | ○ | ○ | | | ○ |

TABLE 1-continued

Silver halide emulsions used in Sample 101

| Emulsion | Characteristics | Av. ESD (μm) | COV (%) | Av. AgI content (mol %) | Structure in halide composition of silver halide grains | AgI content at grain surface (mol %) | Other characterisitics (1) | (2) | (3) | (4) | (5) |
|---|---|---|---|---|---|---|---|---|---|---|---|
| T | Monodispersed (111) tabular grains Av. aspect ratio 8.0 | 0.50 | 12 | 7.0 | Quadruple structure | 4.5 | ○ | | | | ○ |

Av. ESD = Equivalent sphere average grain size; COV = Coefficient of variation
(Other characteristics)
The mark "○" means each of the conditions set forth below is satisfied.
(1) A reduction sensitizer was added during grain formation;
(2) A selenium sensitizer was used as an after-ripening agent
(3) A rhodium salt was added during grain formation.
(4) A shell was provided subsequent to after-ripening by using silver nitrate in an amount of 10%, in terms of silver molar ratio, of the emulsion grains at that time, together with the equimolar amount of potassium bromide
(5) The presence of dislocation lines in an average number of ten or more per grain was observed by a transmission electron microscope.
Note that all the lightsensitive emulsion were after-ripped by the use of sodium thiosulfate, sodium thiocyanate, and sodium aurichloride. Note, also, a iridium salt was added during grain formation.
Note, also, that chemically-modified gelatin whose amino groups were partially converted to phthalic acid amide, was added to emulsions B, C, E, H, J, N, and Q.

TABLE 2

Spectral sensitizing method of Emulsion A to T

| Emulsion | Spectral sensitizing dye added | Addition amount per mol of silver halide (g) | Timing at which the sensitizing dye was added |
|---|---|---|---|
| A | S-1 | 0.01 | Subsequent to after-ripening |
| | S-2 | 0.35 | Prior to after-ripening |
| | S-3 | 0.02 | Prior to after-ripening |
| | S-8 | 0.03 | Prior to after-ripening |
| | S-13 | 0.015 | Prior to after-ripening |
| | S-14 | 0.01 | Prior to after-ripening |
| B | S-2 | 0.35 | Prior to after-ripening |
| | S-3 | 0.02 | Prior to after-ripening |
| | S-8 | 0.03 | Prior to after-ripening |
| | S-13 | 0.015 | Prior to after-ripening |
| | S-14 | 0.01 | Prior to after-ripening |
| C | S-2 | 0.45 | Prior to after-ripening |
| | S-8 | 0.04 | Prior to after-ripening |
| | S-13 | 0.02 | Prior to after-ripening |
| D | S-2 | 0.5 | Subsequent to after-ripening |
| | S-3 | 0.05 | Subsequent to after-ripening |
| | S-8 | 0.05 | Prior to after-ripening |
| | S-13 | 0.015 | Prior to after-ripening |
| E | S-1 | 0.01 | Prior to after-ripening |
| | S-2 | 0.45 | Prior to after-ripening |
| | S-8 | 0.05 | Prior to after-ripening |
| | S-13 | 0.01 | Subsequent to after-ripening |
| F | S-2 | 0.4 | Prior to after-ripening |
| | S-3 | 0.04 | Prior to after-ripening |
| | S-8 | 0.04 | Prior to after-ripening |
| G | S-4 | 0.3 | Subsequent to after-ripening |
| | S-5 | 0.05 | Subsequent to after-ripening |
| | S-12 | 0.1 | Subsequent to after-ripening |
| H | S-4 | 0.2 | Prior to after-ripening |
| | S-5 | 0.05 | Subsequent to after-ripening |
| | S-9 | 0.15 | Prior to after-ripening |
| | S-14 | 0.02 | Subsequent to after-ripening |
| I | S-4 | 0.3 | Prior to after-ripening |
| | S-9 | 0.2 | Prior to after-ripening |
| | S-12 | 0.1 | Prior to after-ripening |
| J | S-4 | 0.35 | Prior to after-ripening |
| | S-5 | 0.05 | Subsequent to after-ripening |
| | S-12 | 0.1 | Prior to after-ripening |

TABLE 2-continued

Spectral sensitizing method of Emulsion A to T

| Emulsion | Spectral sensitizing dye added | Addition amount per mol of silver halide (g) | Timing at which the sensitizing dye was added |
|---|---|---|---|
| K | S-4 | 0.3 | Prior to after-ripening |
| | S-9 | 0.05 | Prior to after-ripening |
| | S-12 | 0.1 | Prior to after-ripening |
| | S-14 | 0.02 | Prior to after-ripening |
| L, M | S-6 | 0.1 | Subsequent to after-ripening |
| | S-10 | 0.2 | Subsequent to after-ripening |
| | S-11 | 0.05 | Subsequent to after-ripening |
| N | S-6 | 0.05 | Subsequent to after-ripening |
| | S-7 | 0.05 | Subsequent to after-ripening |
| | S-10 | 0.25 | Subsequent to after-ripening |
| | S-11 | 0.05 | Subsequent to after-ripening |
| O | S-10 | 0.4 | Subsequent to after-ripening |
| | S-11 | 0.15 | Subsequent to after-ripening |
| P | S-6 | 0.05 | Subsequent to after-ripening |
| | S-7 | 0.05 | Subsequent to after-ripening |
| | S-10 | 0.3 | Prior to after-ripening |
| | S-11 | 0.1 | Prior to after-ripening |
| Q | S-6 | 0.05 | Prior to after-ripening |
| | S-7 | 0.05 | Prior to after-ripening |
| | S-10 | 0.2 | Prior to after-ripening |
| | S-11 | 0.25 | Prior to after-ripening |
| R | S-15 | 0.25 | Prior to after-ripening |
| | S-4 | 0.25 | Prior to after-ripening |
| S | S-15 | 0.30 | Prior to after-ripening |
| | S-4 | 0.30 | Prior to after-ripening |
| T | S-10 | 0.25 | Prior to after-ripening |

C-1
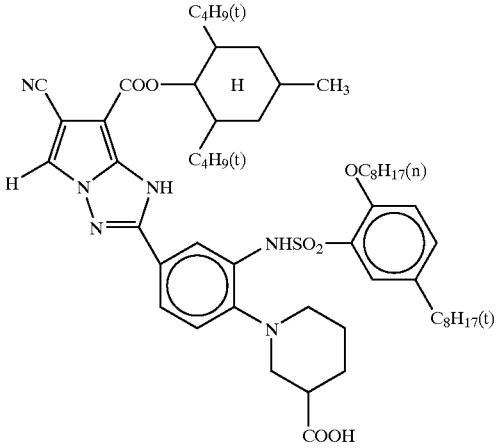
C-2
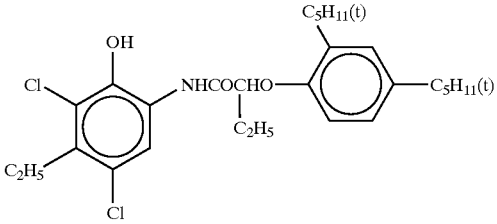
C-3
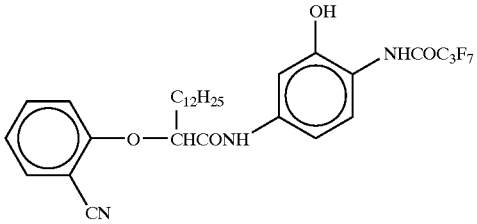
C-4
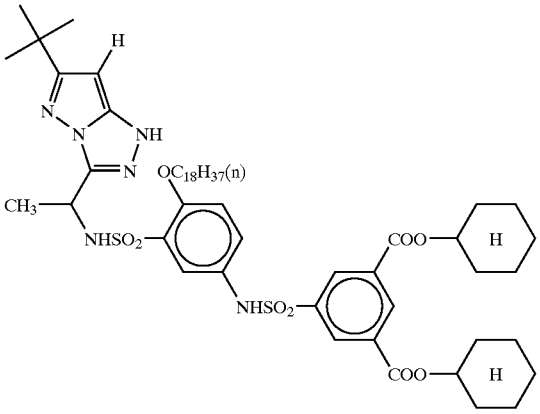
C-5
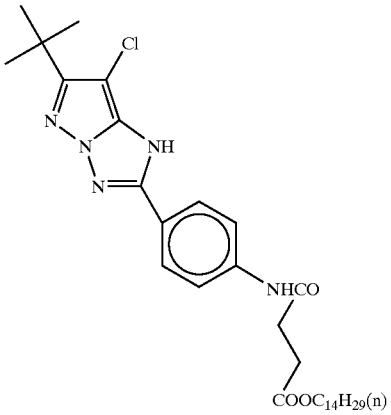
C-6
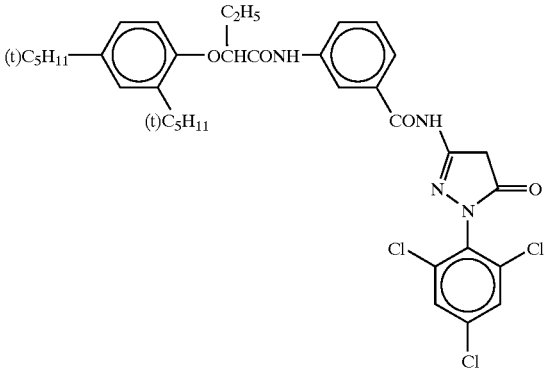

-continued
C-7
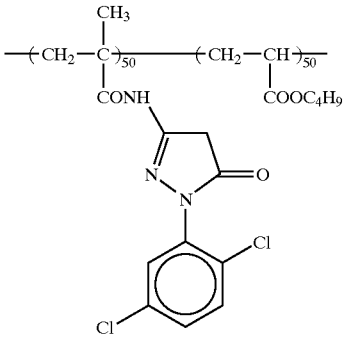
The numbers are in weight %
Average mol. weight: about 25,000
C-8
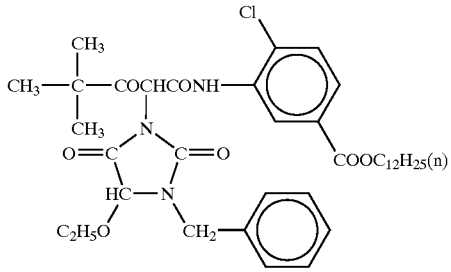
C-9
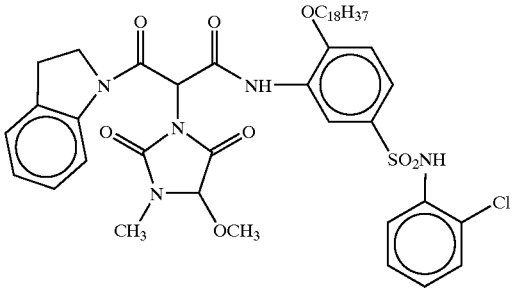
C-10
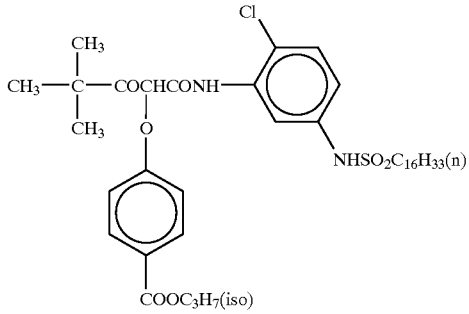
C-11
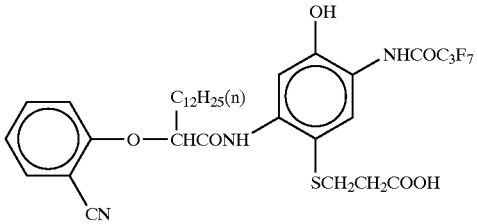
C-12
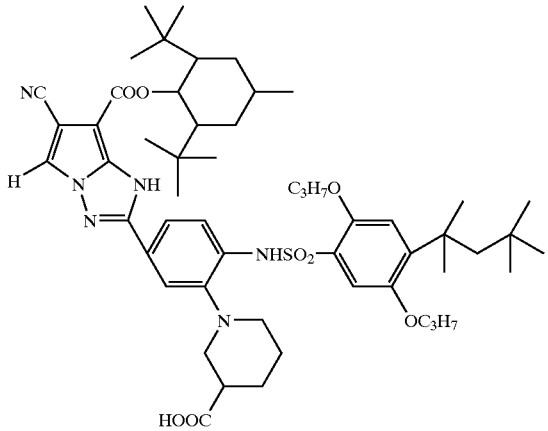
C-13
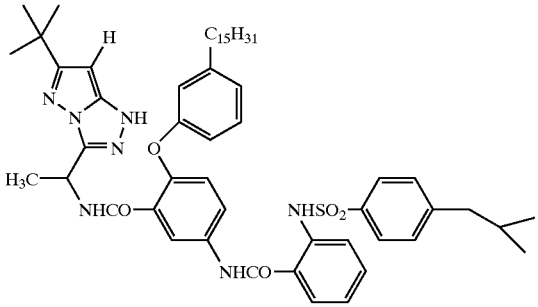
C-14
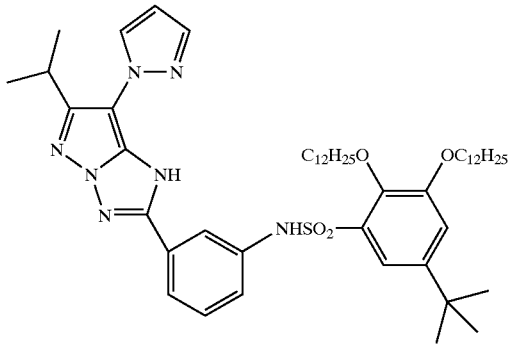
Oil-1
Tri-n-hexyl phosphate
Oil-2
Tricresyl phosphate

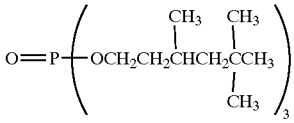
Bis(2-ethylhexyl) succinate
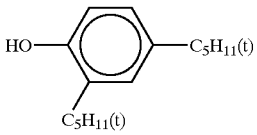
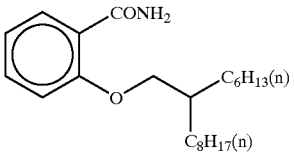
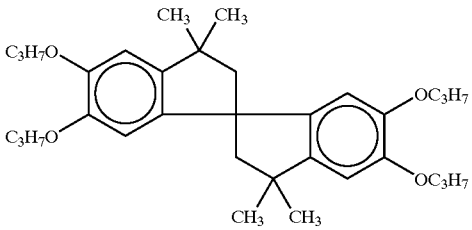
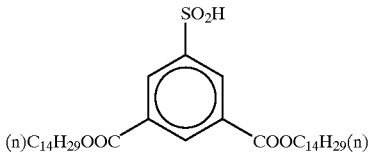
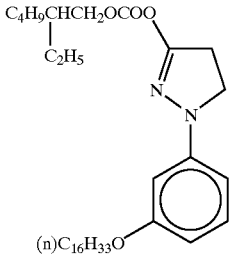
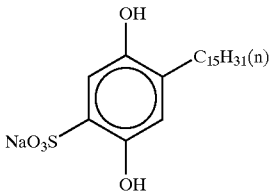
-continued
Oil-3
Tricyclohexyl phosphate
Oil-4
Oil-5
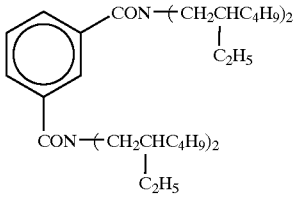
Oil-6
Oil-7
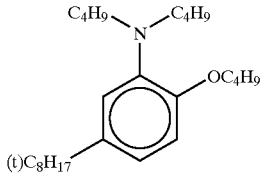
Oil-9
Oil-10
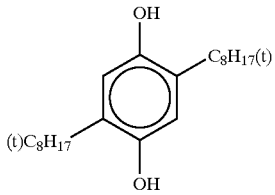
Cpd-A
Cpd-B
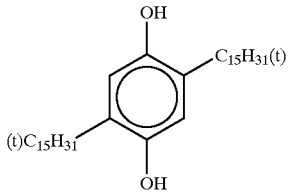
Cpd-C
Cpd-D
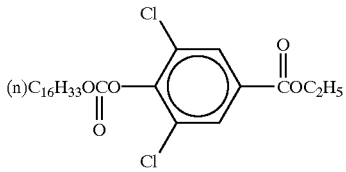
Cpd-F
Cpd-G
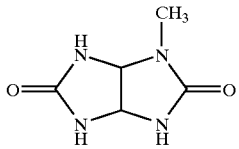
Cpd-H
Cpd-I
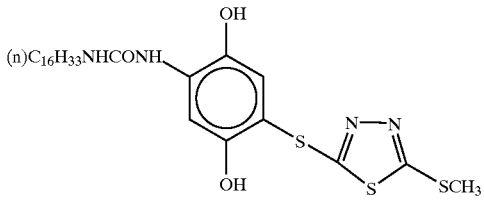
Cpd-J -continued
Cpd-K
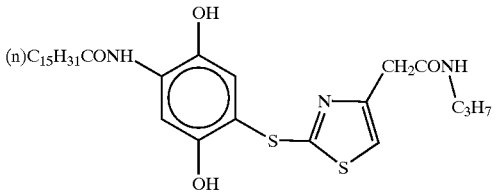
Cpd-M
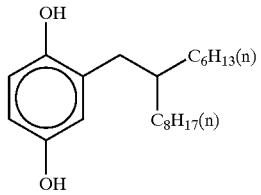
Cpd-N
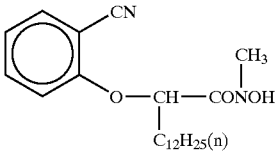
Cpd-O
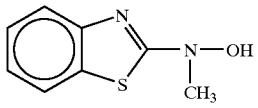
Cpd-P
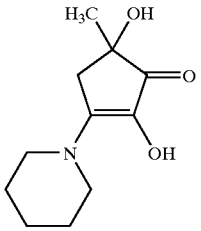
Cpd-Q
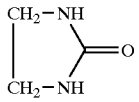
Cpd-R
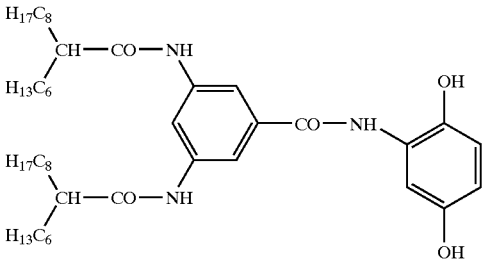
Cpd-S
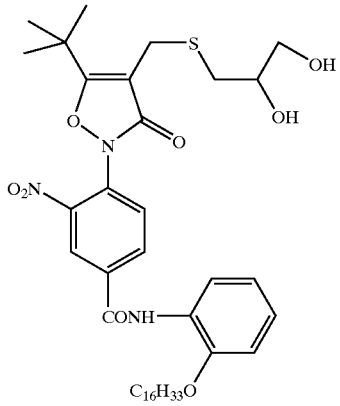
Cpd-T
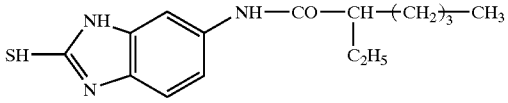
Cpd-U
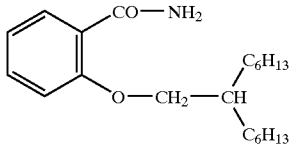
Cpd-V
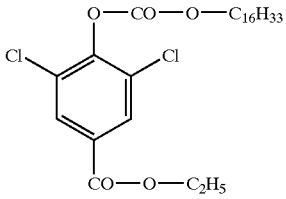
Cpd-W
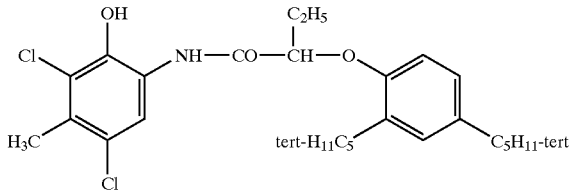
Cpd-X
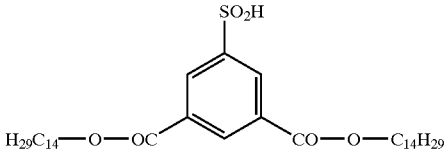
U-1
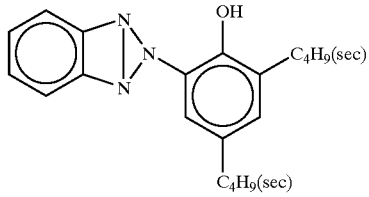

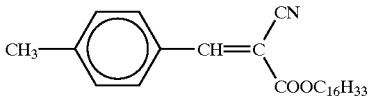
-continued
U-2
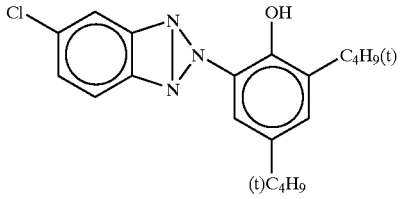
U-3
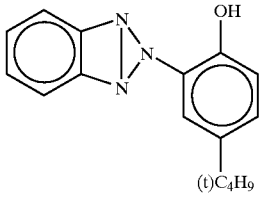
U-4
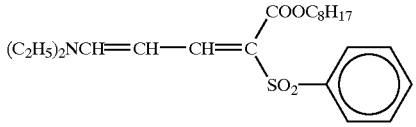
U-5
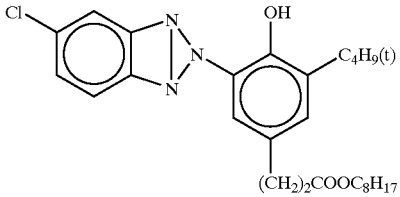
U-6
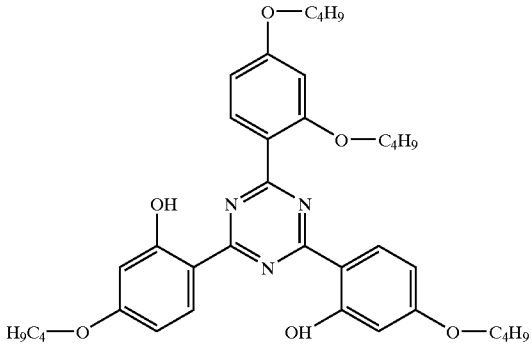
U-7
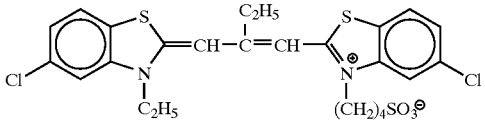
S-1
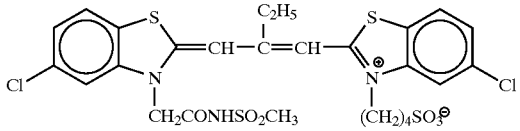
S-2
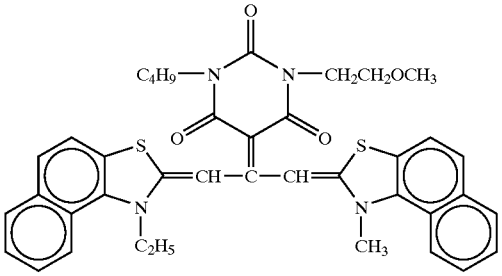
S-3
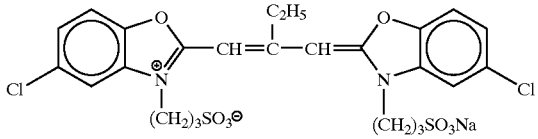
S-4
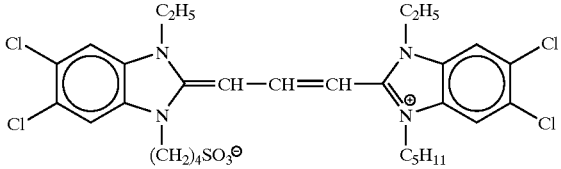
S-5
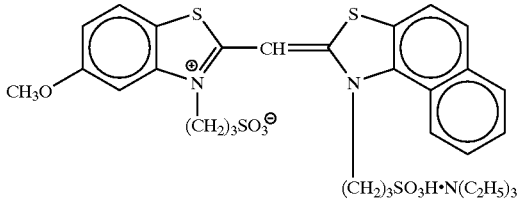
S-6
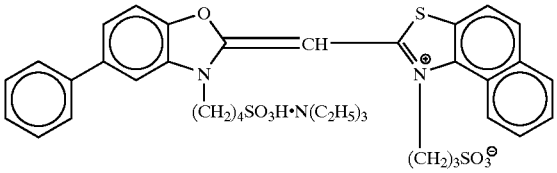
S-7
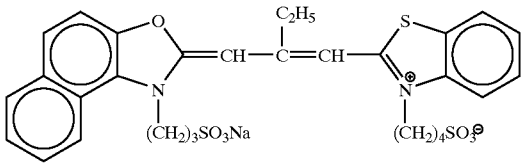
S-8

-continued
S-9
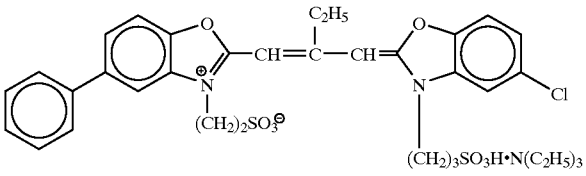
S-10
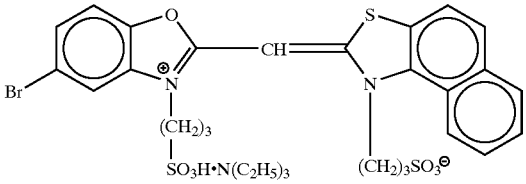
S-11
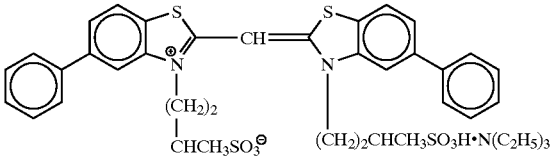
S-12
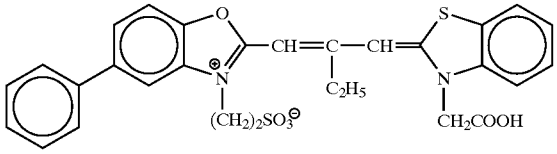
S-13
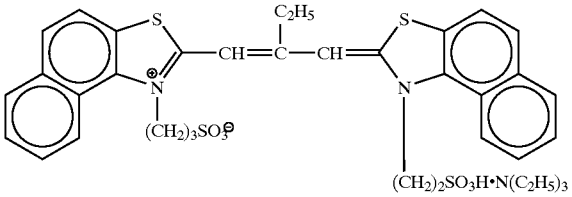
S-14
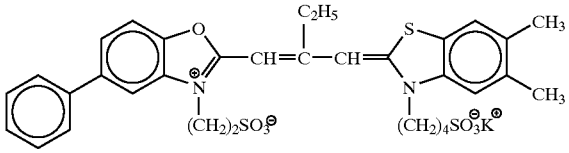
S-15
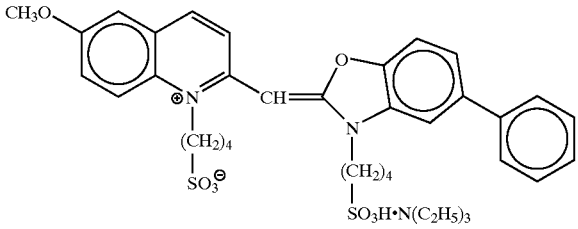
S-16
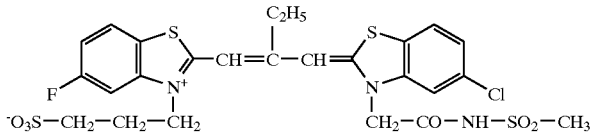
S-17
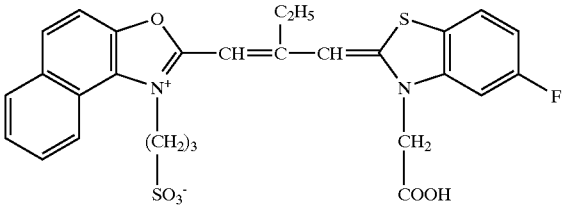
D-1
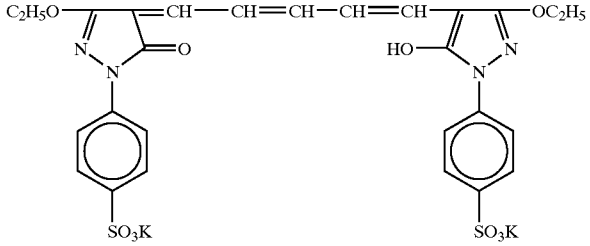
D-2
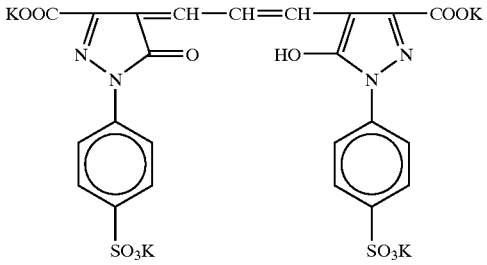
D-3
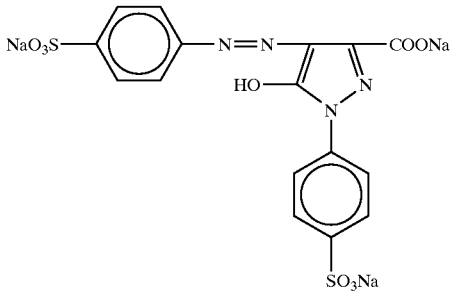

-continued
D-4
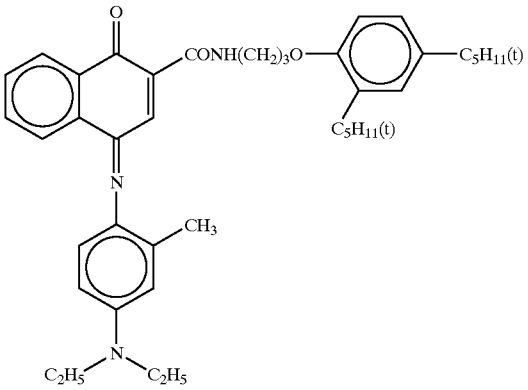
D-5
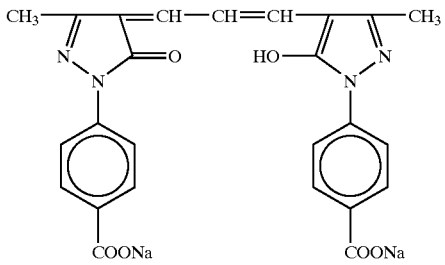
D-7
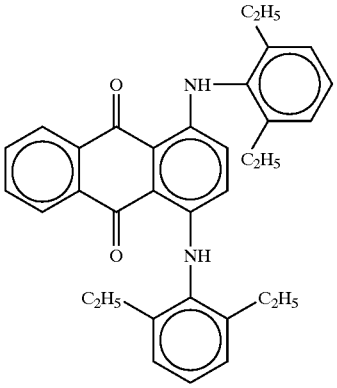
D-8
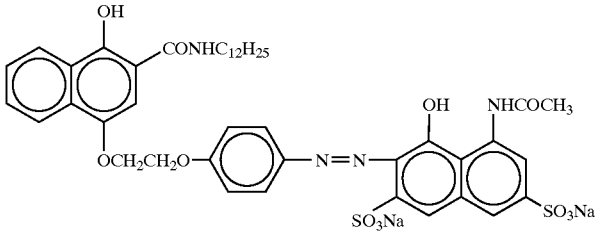
D-9
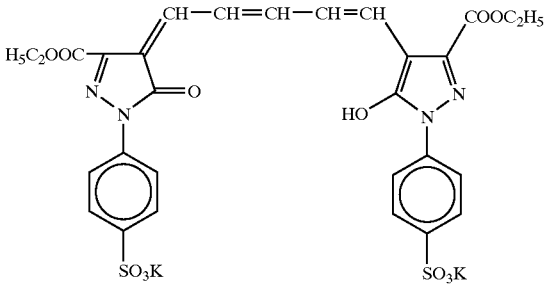
D-10
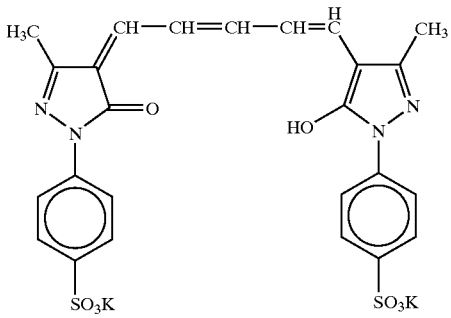
E-1
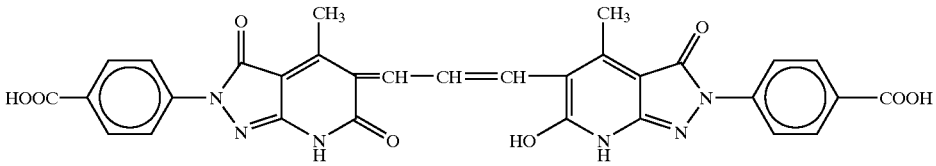
E-2
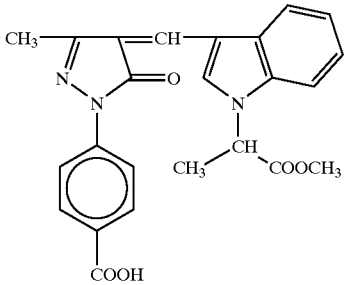
H-1
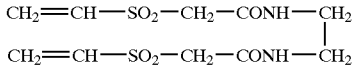

$C_8F_{17}SO_2NHCH_2CH_2CH_2OCH_2CH_2\overset{\oplus}{N}(CH_3)_3$
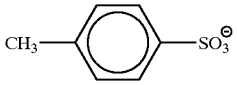
$NaO_3S-CH(CH_2COOCH_2CH(C_2H_5)C_4H_9)COOCH_2CH(C_2H_5)C_4H_9$
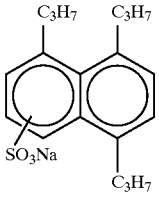
$C_8H_{17}OCOCH_2CH(SO_3Na)COOCH_2CH_2(C_4F_9)$
$-(CH_2-CH(CONHC_4H_9(t)))_n-$
(n = 100–1000)
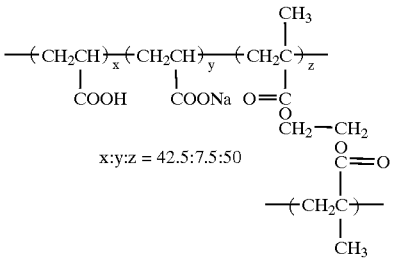
x:y:z = 42.5:7.5:50
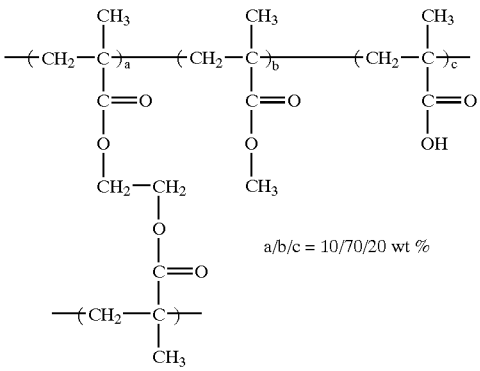
a/b/c = 10/70/20 wt %
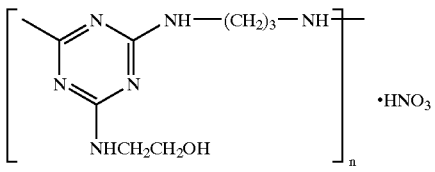
(n = 3~4)
-continued
W-1
$C_8F_{17}SO_2N(C_3H_7)CH_2COOK$
W-2
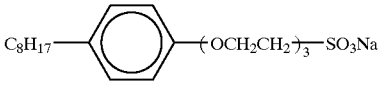
W-3
W-4
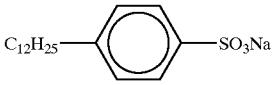
W-5
W-6
W-7
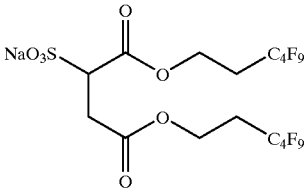
W-8
P-1
$-(CH_2-CH(COOC_2H_5))_n-$
(n = 100–1000)
P-2
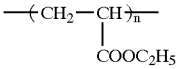
(n = 100–1000)
P-3
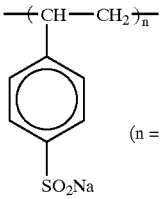
(n = 100–1000)
P-4
P-5
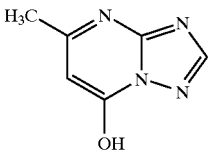
F-1
F-2
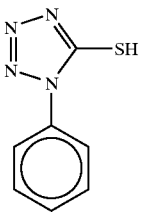
F-3

-continued

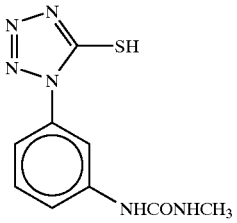

F-4

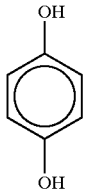

F-5

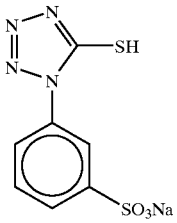

F-6

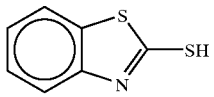

F-7

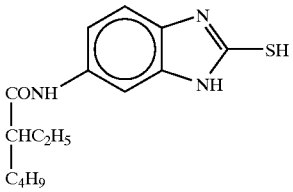

F-8

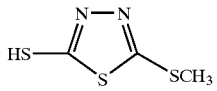

F-9

SO-1

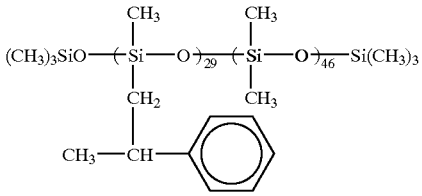

Compound I-1 described in U.S.P. 6, 288, 227

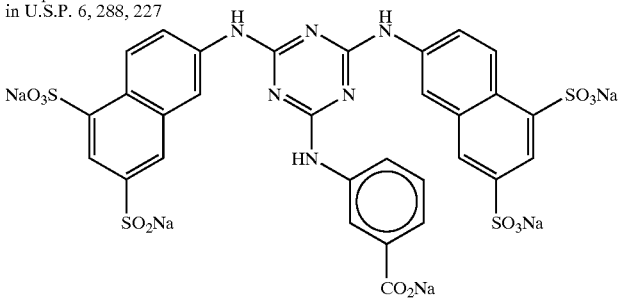

(Preparation of Fine Crystalline Solid Dispersion of Dye E-1

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 2 hr. The beads were filtered out, and water was added to dilute the material to a dye concentration of 3%. After that, the material was heated to 90° C. for 10 hr for stabilization. The average grain size of the obtained fine dye grains was 0.30 μm, and the grain size distribution (grain size standard deviation×100/average grain size) was 20%.

(Preparation of Fine Crystalline Solid Dispersion of Dye E-2

Water and 270 g of W-4 were added to 1,400 g of a wet cake of E-2 containing 30 weight % of water, and the resultant material was stirred to form a slurry having an E-2 concentration of 40 weight %. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 8 hr, thereby obtaining a solid fine-grain dispersion of E-2. This dispersion was diluted to 20 weight % by ion exchange water to obtain a fine crystalline solid dispersion. The average grain size was 0.15 μm.

The film thickness of the sample 101 was 26.5 μm, and the film thickness thereof when it expanded with $H_2O$ at 25° C. was 47.8 μm. Other various characteristics of the sample 101 are set forth in Table 3.

In the sample 101, the weight-averaged wavelength of spectral sensitivity distribution λn of each emulsion layer was the same as its maximum absorption wavelength λmax (n).

TABLE 3

| Various characteristics of Sample 101 | | | | |
|---|---|---|---|---|
| Color-sensitive layer | (λn) | Average silver iodide content (I mol %) | Silver coating amount (AgW) | Total iodide amount (I) |
| Red-sensitive emulsion layer | 600 nm | 2.84 mol % | 1.10 g/m$^2$ | 3.12 |
| Long wavelength green-sensitive emulsion layer | 550 nm | 3.47 mol % | 1.80 g/m$^2$ | 6.25 |
| Short wavelength green-sensitive emulsion layer | 530 nm | 10.00 mol % | 0.60 g/m$^2$ | 6.00 |
| Long wavelength blue-sensitive emulsion layer | 460 nm | 2.50 mol % | 1.25 g/m$^2$ | 3.12 |
| Short wavelength blue-sensitive emulsion layer | 430 nm | 7.00 mol % | 0.27 g/m$^2$ | 1.89 |
| | | Ratio in the average silver iodide contents | Ratio in the silver coating amounts | Ratio in the total iodide amounts |
| Short wavelength green-sensitive emulsion layer / Long wavelength green-sensitive emulsion layer | | 2.88 times | 0.33 times | 96% |
| Short wave length blue-sensitive emulsion layer / Long wavelength blue-sensitive emulsion layer | | 2.80 times | 0.22 times | 61% |

In the sample 101, the short-wavelength-green-sensitive emulsion layer (CL layer) of the invention corresponds to the 3rd layer, the short-wavelength-blue-sensitive emulsion layer (VL layer) corresponds to the 13th layer, and the non-lightsensitive layer having a color mixing prevention ability which is provided between the CL layer and a lightsensitive emulsion layer other than the CL layer corresponds to the 4th layer. In the 4th layer, 310 mg/m$^2$ of monoalkyl hydroquinone (Cpd-M) is added as a color mixing prevention agent, and the thickness of the layer is 2.3 μm.

Development Processing and Evaluation Method of Color Fidelity

A sample prepared was cut into a Brownie size with a width of 60 mm, then processed, mounted in a Brownie camera, and a Macbeth color chart was photographed under daylight. Further, development processing set forth below was conducted to visually evaluate color fidelity.

Further, concerning the fine change of the color fidelity, the RGB densities of photographed image was measured, plotted on a Lab chromaticity diagram, and the relative positional relation of the color of the Macbeth color chart with the chromaticity diagram plotting was confirmed and evaluated.

In the processing, a running processing was performed before the processing for the evaluation. In the running processing, Sample 101 before exposure to light and the same sample after full exposure to light in a ratio of 1:1 were processed until the accumulated replenisher amount of each solution was four times the tank volume.

| Processing Step | Time | Temperature | Tank volume | Replenishment rate |
|---|---|---|---|---|
| 1st development | 6 min | 38° C. | 37 L | 2,200 mL/m$^2$ |
| 1st washing | 2 min | 38° C. | 16 L | 7,500 mL/m$^2$ |
| Reversal | 2 min | 38° C. | 17 L | 1,100 mL/m$^2$ |
| Color development | 6 min | 38° C. | 30 L | 2,200 mL/m$^2$ |
| Pre-bleaching | 2 min | 38° C. | 19 L | 1,100 mL/m$^2$ |
| Bleaching | 6 min | 38° C. | 30 L | 220 mL/m$^2$ |

-continued

| Processing Step | Time | Temperature | Tank volume | Replenishment rate |
|---|---|---|---|---|
| Fixing | 4 min | 38° C. | 29 L | 1,100 mL/m$^2$ |
| 2nd washing | 4 min | 38° C. | 35 L | 7,500 mL/m$^2$ |
| Final rinsing | 1 min | 25° C. | 19 L | 1,100 mL/m$^2$ |

Although the initial composition of each processing solution is that as set forth below, in addition to these, each solution contains eluted substances from the photographic material that is processed.

| <1st developer> | <Tank solution> | <Replenisher> |
|---|---|---|
| Nitrilo-N,N,N-trimethylene phosphonic acid · pentasodium salt | 1.5 g | 1.5 g |
| Diethylenetriamine pentaacetic acid · pentasodium salt | 2.0 g | 2.0 g |
| Sodium sulfite | 30 g | 30 g |
| Hydroquinone · potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 2.5 g | 3.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid · pentasodium salt | 3.0 g | the same as tank solution |
| Stannous chloride · dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid · pentasodium salt | 2.0 g | 2.0 g |
| Sodium sulfite | 7.0 g | 7.0 g |
| Trisodium phosphate · dodecahydrate | 36 g | 36 g |
| Potassium bromide | 1.0 g | — |
| Potassium iodide | 90 mg | — |
| Sodium hydroxide | 12.0 g | 12.0 g |
| Citrazinic acid | 0.5 g | 0.5 g |
| N-ethyl-N-(β-methanesulfon amidoethyl)-3-methyl-4 aminoaniline · 3/2 sulfuric acid · monohydrate | 10 g | 10 g |
| 3,6-dithiaoctane-1,8-diol | 1.0 g | 1.0 g |
| Water to make | 1,000 mL | 1,000 mL |
| pH | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid · disodium salt · dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.3 | 6.10 |

The pH was adjusted by acetic acid or sodium hydroxide.

| <Bleaching solution> | <Tank solution> | <Replenisher> |
|---|---|---|
| Ethylenediaminetetraacetic acid · disodium salt · dihydrate | 2.0 g | 4.0 g |
| Ethylenediaminetetraacetic acid · Fe (III) · ammonium · dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

Note that in the development processing step, the solution of each bath was continuously circulated and stirred, and at the bottom of each tank was provided with a bubbling pipe having small apertures of 0.3 mm diameter in an interval of 1 cm, and nitrogen gas was bubbled through the apertures to stir the solution.

Comparison with Respective Samples

Various prescription factors were changed for the sample 101, and it was studied what effect was exerted on the color fidelity.

Adjustment was carried out so that the variation of sensitivity, gradation and the like due to the changes in various prescription factors become the same as those of the sample 101 by known methods such as the adjustment of emulsion sensitivity by change of a grain size.

In each sample, the weight-averaged wavelength of spectral sensitivity distribution $\lambda n$ of each emulsion layer was the same as its maximum absorption wavelength $\lambda max(n)$.

(1) Effects of Providing a Short-wavelength-green-sensitive Emulsion Layer

When the short-wavelength-green-sensitive emulsion layer (3rd layer) was removed, the saturation of green was lowered, and the color separation between yellowish green and green deteriorated.

(2) Influence of an Average Silver Iodide Content and Coated Silver Amount of Silver Halide Grains contained in a Short-wavelength-green-sensitive Emulsion Layer When the average silver iodide contents of the silver halide grains contained in the short-wavelength-green-sensitive emulsion layer were decreased to 0.75-fold, 0.55-fold, and 0.33-fold, while the ratio of the average silver iodide contents of the short-wavelength-green-sensitive emulsion layer/the green-sensitive emulsion layers was changed 2.1-fold, 1.5-fold, and 0.9-fold, respectively, the saturation of green was lowered, and the color separation between yellowish green and green deteriorated. When the silver iodide content was decreased to 0.33-fold the saturation and the color separation deteriorated to the same level as a photographic material from which the short-wavelength-green-sensitive emulsion layer was removed, and the advantages of proving short-wavelength-green-sensitive emulsion layer were not recognized at all. Further, when the coated amount of the short-wavelength-green-sensitive emulsion layer was decreased to 0.75-fold, 0.55-fold, and 0.33-fold, while the ratio of the coated amounts of the short-wavelength-green-sensitive emulsion layer/the green-sensitive emulsion layers was changed 0.17-fold, 0.12-fold, and 0.07-fold, respectively, the similar changes occurred. When the coated amount of the short-wavelength-green-sensitive emulsion layer was decreased to 0.33-fold the saturation and the separation deteriorated to the same level as a photographic material from which the short-wavelength-green-sensitive emulsion layer was removed, and the advantages of providing short-wavelength-green-sensitive emulsion layer was hardly recognized.

(3) Effect of Providing a Short-wavelength-blue-sensitive Emulsion Layer

When the short-wavelength-blue-sensitive emulsion layer (13th layer) was removed, the saturations of blue and green were lowered, and the color difference between yellowish green and green was hard to be observed. When the 3rd layer and the 13th layer were removed to make only three-color-sensitive layers of the BL, GL and RL layers, the saturations of primary colors such as blue, green, red, yellow and the like were lowered.

(4) Influence of an Average Silver Iodide Content or Coated Silver Amount of Silver Halide Grains Contained in a Short-wavelength-blue-sensitive Emulsion Layer When the average silver iodide content of the silver halide grains contained in the short-wavelength-blue-sensitive emulsion layer was decreased to 0.67-fold, 0.45-fold, and 0.29-fold, while the ratio of the average silver iodide contents of the short-wavelength-blue-sensitive emulsion layer/the blue-sensitive emulsion layers was changed 1.9-fold, 1.3-fold, and 0.8-fold, respectively, the saturations of blue and green were lowered, together with the separation between yellowish green and green deteriorated. When the silver iodide content was decreased to 0.29-fold, the saturations and the separation deteriorated to nearly the same level as a photographic material from which the short-wavelength-blue-sensitive emulsion layer was removed, and the advantages of providing short-wavelength-blue-sensitive emulsion layer were not recognized at all. Further, when the coated silver amount of the short-wavelength-blue-sensitive emulsion layer was decreased to 0.67-fold, 0.45-fold, and 0.29-fold, while the ratio of the coated silver amounts of the short-wavelength-blue-sensitive emulsion layer/the blue-sensitive emulsion layers was changed 0.22-fold, 0.15-fold, and 0.097-fold, respectively, similar changes occurred. When the amount was decreased to 0.29-fold, the saturations and separation deteriorated to nearly the same level as a photographic material from which the short-wavelength-blue-sensitive emulsion layer was removed, and the advantages of providing short-wavelength-blue-sensitive emulsion layer were hardly recognized.

(5) Effect of Providing an Intermediate Layer, i.e., Color Mixing Prevention Layer, Between a Short-wavelength-green-sensitive Emulsion Layer and Another Color Sensitive Layer When the 4th layer was removed, saturations from orange to red were lowered extremely.

(6) Influence of the Film Thickness of a Color Mixing Prevention Layer and Amount of a Color Mixing Prevention Agent When the gelatin amount in the 4th layer of the sample 101 was reduced and thereby the film thickness thereof was made thinner from 2.3 $\mu$m to 1.8 $\mu$m, 1.3 $\mu$m, and 0.8 $\mu$m, the saturation from orange to red were lowered to gradually became closer to the case where the 4th layer is not provided. Especially, when the film thickness is thinner than 1.3 $\mu$m, nearly similar color reproduction as in the case where the 4th layer was removed, was revealed.

Also, when the monoalkyl type hydroquinone compound (Cpd-M) that is contained in the 4th layer was decreased from 320 mg/m$^2$ to 240, 160 and 80 mg/m$^2$, the similar change as mentioned above was revealed. Further, when the amount was decreased to 40 mg/m$^2$ and further to 0 mg/m$^2$, cyan color was mixed in bright pink color, which means deterioration from a view point of general color reproduction. On the other hand, when the amount was increased to 640 mg/m$^2$ and further to 1280 mg/m$^2$, the lowering in saturations of blue and cyan colors was observed. In particular, when the amount was 1280 mg/m$^2$, yellow was mixed in the color of a white subject, and clear highlight were not obtained.

(7) Influence of a Kind of a Color-preventing Agent Contained in a Color Mixing Prevention Layer When the Cpd-M contained in the 4th layer is changed to Cpd-A or Cpd-C in the same weight, the saturations of red and orange were slightly lowered.

(8) Influence of $\lambda$C

When the $\lambda$C of the short-wavelength-green-sensitive emulsion layer was changed to 450, 480, 500, 520, 540 and 565 nm by changing the ratio of the sensitizing dyes S-15 and S-4 to be added in emulsions R and S that were contained in the short-wavelength-green-sensitive emulsion layer, the saturation of green and the discrimination property between yellowish green and green were changed. Note that when S-4 is increased, $\lambda$C becomes longer wavelength. The sample 101 having $\lambda$C=530 nm was most preferable. In particular, when $\lambda$C was set at 450 nm and 480 nm, magenta color was mixed with blue, and when $\lambda$C was set at 565 nm, magenta color was mixed with green, therefore the respective saturations were lowered.

(9) Influence of $\lambda$V

When $\lambda$V was made longer from 430 nm to 460 nm by adding S-11 to the emulsion T that was contained in the short-wavelength-blue-sensitive emulsion layer, the saturation of blue was lowered. Further, when $\lambda$V was set at 480 nm, bright color of the sea became yellowish. Further, when $\lambda$V was set at 390 nm, a similar color reproduction as in the case where the short-wavelength-green-sensitive emulsion layer was omitted, was obtained, and the advantages of providing a short-wavelength-blue-sensitive emulsion layer was not recognized.

(10) Influence of $\lambda$R

When the $\lambda$R was changed to 550, 580, 615, 630 and 650 nm by changing the ratio of the sensitizing dyes to be added into the emulsions A to F that were contained in the red-sensitive emulsion layers, purple was tinged with red when $\lambda$R was made longer, and it became too blue when $\lambda$R was made shorter. Further, when $\lambda$R was set at 520 nm, the saturation of red was lowered greatly and when $\lambda$R was set at 675 nm, there occurred an adverse effect that purple became crimson.

(12) Influence of a Color Coupler Contained in a Short-wavelength-green-sensitive Emulsion Layer When the magenta coupler C-6 or the yellow coupler C-8 was added in the short-wavelength-green-sensitive emulsion layer (the 3rd layer) of the sample 101, the saturations of green and red were lowered.

(13) Influence of the Position at Which a Short-wavelength-green-sensitive Emulsion Layer is Provided The short-wavelength-green-sensitive emulsion layer (the 3rd layer) was removed from the sample 101 and a layer having the same composition as this was provided between the 8th and 9th layers, or between the 11th and 12th layers. The sample 101 had superior saturations of green and red.

(14) Influence of the Position at Which a Short-wavelength-blue-sensitive Emulsion Layer is Provided The short-wavelength-blue-sensitive emulsion layer (the 3rd layer) was removed from the sample 101 and a layer having the same composition as this layer was provided between the 16th and 17th layers. The sample 101 had superior saturations of blue and green.

(15) Configuration of a Short-wavelength-green-sensitive Emulsion Layer

The short-wavelength-green-sensitive emulsion layer (the 3rd layer) of the sample 101 was divided into two sub-layers, and the emulsion S (silver amount=0.30 g) and gelatin (0.245 g) were added to the side closer to the support and the emulsion R (silver amount=0.30 g) and gelatin (0.245 g) were added to the side farther from the support. As a result, faithfulness over from blue to green at the highlight side was enhanced.

Further, in the above-mentioned layer configuration, the emulsion S that was added to the side closer to the support was replaced with the same emulsion as emulsion S, except that 0.2 g, in terms of silver amount, of a rhodium salt was added thereto, and thereby desensitized the thus obtained emulsion by 0.4 logE. As a result, the improvement in color fidelity at the highlight was further recognized.

(16) Effect of Mixing Couplers

Two samples were prepared by adding the magenta coupler C-5 into the red-sensitive emulsion layers, of the sample 101, i.e., from the 5th to 7th layers, in an amount corresponding to 1.30 mol and 1/10 mol of C-1, respectively. Photographing was carried out by matching gray with a filter, redness in fresh color was removed and the preferable reproduction of flesh color was obtained. Further, a sample was prepared by adding the yellow coupler C-8 into the green-sensitive emulsion layers of the sample 101, i.e., from the 9th to 11th layers. Evaluation in flesh color reproduction was similarly conducted to reveal that the flesh color tone continuity was improved.

(17) Influence of Configuration in Spectral Sensitivity Distribution in a Red-sensitive Emulsion Layer Every λR of the red-sensitive emulsion layers in the sample 101 was 600 nm. Samples 103 to 106 were prepared by changing the sensitizing dyes that were added in the emulsions, were changed as in Table 4. λn's of the respective layers in the respective cases are described in Table 4.

TABLE 4

| | | | Spectral sensitizing dye added and addition amount per mol of silver halide (g) | | | | | | | | λn |
|---|---|---|---|---|---|---|---|---|---|---|---|
| Sample | Layer | Emulsion | S-1 | S-2 | S-3 | S-8 | S-13 | S-14 | S-16 | S-17 | (nm) |
| 101 | Low-speed Red-sens. E.L. (5th layer) | A | 0.010 | 0.350 | 0.020 | 0.030 | 0.015 | 0.010 | 0.000 | 0.000 | 600 |
| | | B | 0.000 | 0.350 | 0.020 | 0.030 | 0.015 | 0.010 | 0.000 | 0.000 | |
| | | C | 0.000 | 0.450 | 0.040 | 0.000 | 0.020 | 0.000 | 0.000 | 0.000 | |
| | Medium-speed Red-sens. E.L. (6th layer) | C | 0.000 | 0.450 | 0.040 | 0.000 | 0.020 | 0.000 | 0.000 | 0.000 | 600 |
| | | D | 0.000 | 0.500 | 0.050 | 0.050 | 0.015 | 0.000 | 0.000 | 0.000 | |
| | High-speed Red-sens. E.L. (7th layer) | E | 0.010 | 0.450 | 0.000 | 0.050 | 0.010 | 0.000 | 0.000 | 0.000 | 600 |
| | | F | 0.000 | 0.400 | 0.040 | 0.040 | 0.000 | 0.000 | 0.000 | 0.000 | |
| 103 | Low-speed Red-sens. E.L. (5th layer) | A | 0.000 | 0.000 | 0.000 | 0.000 | 0.015 | 0.000 | 0.380 | 0.040 | 640 |
| | | B | 0.000 | 0.000 | 0.000 | 0.000 | 0.015 | 0.000 | 0.370 | 0.040 | |
| | | C | 0.000 | 0.000 | 0.000 | 0.000 | 0.020 | 0.000 | 0.450 | 0.045 | |
| | Medium-speed Red-sens. E.L. (6th layer) | C | 0.000 | 0.000 | 0.000 | 0.000 | 0.020 | 0.000 | 0.450 | 0.045 | |
| | | D | 0.000 | 0.000 | 0.000 | 0.000 | 0.015 | 0.000 | 0.550 | 0.055 | |
| | High-speed Red-sens. E.L. (7th layer) | E | 0.000 | 0.000 | 0.000 | 0.000 | 0.010 | 0.000 | 0.450 | 0.045 | 640 |
| | | F | 0.000 | 0.000 | 0.000 | 0.000 | 0.000 | 0.000 | 0.450 | 0.045 | |
| 104 | Low-speed Red-sens. E.L. (5th layer) | A | 0.000 | 0.000 | 0.000 | 0.000 | 0.015 | 0.000 | 0.270 | 0.150 | 600 |
| | | B | 0.000 | 0.000 | 0.000 | 0.000 | 0.015 | 0.000 | 0.260 | 0.150 | |
| | | C | 0.000 | 0.000 | 0.000 | 0.000 | 0.020 | 0.000 | 0.310 | 0.180 | |
| | Medium-speed Red-sens. E.L. (6th layer) | C | 0.000 | 0.000 | 0.000 | 0.000 | 0.020 | 0.000 | 0.310 | 0.180 | 620 |
| | | D | 0.000 | 0.000 | 0.000 | 0.000 | 0.015 | 0.000 | 0.430 | 0.170 | |
| | High-speed Red-sens. E.L. (7th layer) | E | 0.000 | 0.000 | 0.000 | 0.000 | 0.010 | 0.000 | 0.450 | 0.045 | 640 |
| | | F | 0.000 | 0.000 | 0.000 | 0.000 | 0.000 | 0.000 | 0.450 | 0.045 | |
| 105 | Low-speed Red-sens. E.L. (5th layer) | A | 0.000 | 0.000 | 0.000 | 0.000 | 0.015 | 0.000 | 0.380 | 0.040 | 640 |
| | | B | 0.000 | 0.000 | 0.000 | 0.000 | 0.015 | 0.000 | 0.370 | 0.040 | |
| | | C | 0.000 | 0.000 | 0.000 | 0.000 | 0.020 | 0.000 | 0.450 | 0.045 | |
| | Medium-speed Red-sens. E.L. (6th layer) | C | 0.000 | 0.000 | 0.000 | 0.000 | 0.020 | 0.000 | 0.450 | 0.045 | 620 |
| | | D | 0.000 | 0.000 | 0.000 | 0.000 | 0.015 | 0.000 | 0.430 | 0.170 | |
| | High-speed Red-sens. E.L. (7th layer) | E | 0.000 | 0.000 | 0.000 | 0.000 | 0.010 | 0.000 | 0.330 | 0.180 | 600 |
| | | F | 0.000 | 0.000 | 0.000 | 0.000 | 0.000 | 0.000 | 0.300 | 0.170 | |
| 106 | Low-speed Red-sens. E.L. (5th layer) | A | 0.000 | 0.000 | 0.000 | 0.000 | 0.015 | 0.000 | 0.270 | 0.150 | 600 |
| | | B | 0.000 | 0.000 | 0.000 | 0.000 | 0.015 | 0.000 | 0.260 | 0.150 | |
| | | C | 0.000 | 0.000 | 0.000 | 0.000 | 0.020 | 0.000 | 0.310 | 0.180 | |
| | Medium-speed Red-sens. E.L. (6th layer) | C | 0.000 | 0.000 | 0.000 | 0.000 | 0.020 | 0.000 | 0.310 | 0.180 | 600 |
| | | D | 0.000 | 0.000 | 0.000 | 0.000 | 0.015 | 0.000 | 0.380 | 0.220 | |

TABLE 4-continued

| Sample | Layer | Emulsion | Spectral sensitizing dye added and addition amount per mol of silver halide (g) | | | | | | | | λn |
|---|---|---|---|---|---|---|---|---|---|---|---|
| | | | S-1 | S-2 | S-3 | S-8 | S-13 | S-14 | S-16 | S-17 | (nm) |
| | High-speed Red-sens. E.L. (7th layer) | E | 0.000 | 0.000 | 0.000 | 0.000 | 0.010 | 0.000 | 0.330 | 0.180 | 60 |
| | | F | 0.000 | 0.000 | 0.000 | 0.000 | 0.000 | 0.000 | 0.300 | 0.170 | |

Red-sens. E.L. = Red-sensitive emulsion layer

As a result, when the high-speed red-sensitive layer has a longer wavelength than that of the low-speed red-sensitive layer as in the sample 104, it was revealed that more preferable color reproduction was obtained.

(18) Influence of a Kind of a Coupler

A sample 107 in which the couple C-1 in the red-sensitive emulsion layers of the sample 104 was changed to C-12, and the couplers C-4 and C-5 in the green-sensitive emulsion layers were changed to the couplers C-13 and C-14, respectively, was prepared.

As a result, it was revealed that the sample 107 attained more preferable color reproduction than that of the sample 101.

(19) Influence of an Additive

A sample 108 in which the compounds Cpd-U and Cpd-V each in an amount of 0.1 g/m$^2$, and 0.15 g/m$^2$ of U-7 were added into the 1st layer of the sample 107, and the compounds Cpd-W and Cpd-X each in an weight ratio of 1/10 with respect to the compound C-12 were added into the red-sensitive emulsion layer, was prepared.

After the development processing of the samples 104, 107 and 108 was carried out, they were preserved for 1 week under conditions of 80° C. and 70% or for 2 weeks under a fluorescent light source. As a result, it was revealed that the change of color caused by the lapse of time for preservation was small in the samples 107 and 108, in particular the sample 108.

(20) Influence of a Surfactant for Coating

A sample 109 was prepared by removing the compounds W-1, W-2, W-4 and W-7 from the sample 108 and the compound W-8, in an amount of 3 g/m$^2$, was added into the 3rd protective layer. As a result, the color reproduction equal to the sample 108 was obtained, therefore it could be confirmed that these surfactants do not influence the object of the invention.

(21) Influence of an Additive in a Protective Layer

A sample 110 was prepared by adding 0.2 g/m$^2$ of the compound P-5 into the 3rd protective layer of the sample 109 and the addition amount of the poly(methyl methacrylate) was made as 1/2. As a result, it was revealed that the coarse feeling of an image disappeared and a preferable photo image was obtained.

(22) Influence of an Additive in a Processing Solution

The development processing of the above-mentioned samples 109 and 110 was carried out using a bleaching bath in which H-6R-AD manufactured by Fuji Photo Film Co., Ltd. was added in an amount of 1 g/L.

Further, the development processing was carried out using a pre-bleaching solution or a fixing solution into which the compound I-1 described in U.S. Pat. No. 6,288,227 was added in an amount of 3.5 g/L.

Although the highlight that should be originally gray was slightly orange by the previous processing without the additive, it was revealed that an appropriate gray was reproduced in both samples when processing was carried out with the processing solution to which the above-mentioned additives were added.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic material comprising at least one blue-sensitive emulsion layer (BL layer), at least one green-sensitive emulsion layer (GL layer) and at least one red-sensitive emulsion layer (RL layer) on a support, wherein, a maximum absorption wavelength of the green-sensitive emulsion layer represented by λmax(G) being in the range of 500 nm≦λmax(G)≦570 nm, and the photographic material further having at least one short-wavelength-green-sensitive emulsion layer (CL layer) meeting the following requirements (i) and (ii):

(i) a maximum absorption wavelength of the CL layer represented by λmax(C) being in the range of 490 nm≦λmax(C)≦560 nm, and 80 nm≧λmax(G)−λmax(C)≧5 nm, and (ii) the total iodine amount of silver halide grains contained in the CL layer being in the range from 60% to 300% of that contained in the green-sensitive emulsion layer.

2. The silver halide color photographic material according to claim 1, wherein the CL layer and/or the VL layer do not substantially form image dye.

3. The silver halide color photographic material according to claim 2, wherein a non-lightsensitive layer having a color mixing prevention ability being provided between the CL layer and a lightsensitive emulsion layer other than the CL layer.

4. The silver halide color photographic material according to claim 1, wherein a non-lightsensitive layer having a color mixing prevention ability being provided between the CL layer and a lightsensitive emulsion layer other than the CL layer.

5. A silver halide color photographic material comprising at least one blue-sensitive emulsion layer (BL layer), at least one green-sensitive emulsion layer (GL layer) and at least one red-sensitive emulsion layer (RL layer) on a support, wherein, a weight-averaged wavelength of spectral sensitivity distribution of the green-sensitive emulsion layer represented by λG being in the range of 500 nm≦G≦570 nm, and the photographic material further having at least one short-wavelength-green-sensitive emulsion layer (CL layer) meeting the following requirements (iii) and (iv):

(iii) a weight-averaged wavelength of spectral sensitivity distribution of the CL emulsion layer represented by λC being in the range of 490 nm≦λC≦560 nm, and 80 nm≧λG−λC≧5 nm, and (iv) the total iodine amount of silver halide grains contained in the CL layer being in the range from 60% to 300% of that contained in the green-sensitive emulsion layer.

6. The silver halide color photographic material according to claim 5, wherein the CL layer do not substantially form image dye.

7. The silver halide color photographic material according to claim 6, wherein a non-lightsensitive layer having a color mixing prevention ability being provided between the CL layer and a lightsensitive emulsion layer other than the CL layer.

8. The silver halide color photographic material according to claim 5, wherein a non-lightsensitive layer having a color mixing prevention ability being provided between the CL layer and a lightsensitive emulsion layer other than the CL layer.

9. A silver halide color photographic material comprising at least one blue-sensitive emulsion layer (BL layer), at least one green-sensitive emulsion layer (GL layer) and at least one red-sensitive emulsion layer (RL layer) on a support, wherein, a maximum absorption wavelength of the blue-sensitive emulsion layer represented by λmax(B) being in the range of 440 nm≦λmax(B)≦500 nm, and the photographic material further having at least one short-wavelength-blue-sensitive emulsion layer (VL layer) meeting the following requirements (v) and (vi):

(v) a maximum absorption wavelength of the VL layer represented by λmax(V) being in the range of 400 nm≦λmax(V)≦460 nm, and 100 nm≧λmax(B)−λmax(V)≧5 nm, and (vi) the total iodine amount of silver halide grains contained in the VL layer being in the range from 40% to 250% of that contained in the blue-sensitive emulsion layer.

10. The silver halide color photographic material according to claim 9, wherein the VL layer do not substantially form image dye.

11. A silver halide color photographic material comprising at least one blue-sensitive emulsion layer (BL layer), at least one green-sensitive emulsion layer (GL layer) and at least one red-sensitive emulsion layer (RL layer) on a support, wherein, a weight-averaged wavelength of spectral sensitivity distribution of the blue-sensitive emulsion layer represented by λB being in the range of 440 nm≦λB≦500 nm, and the photographic material further having at least one short-wavelength-blue-sensitive emulsion layer (VL layer) meeting the following requirements (vii) and (viii):

(vii) a weight-averaged wavelength of spectral sensitivity distribution of the VL layer represented by λV being in the range of 400 nm≦λV≦460 nm, and 100 nm≧λB−λV≧5 nm, and (viii) the total iodine amount of silver halide grains contained in the VL layer being in the range from 40% to 250% of that contained in the blue-sensitive emulsion layer.

12. The silver halide color photographic material according to claim 11, wherein the VL layer do not substantially form image dye.

13. A silver halide color photographic material comprising at least one blue-sensitive emulsion layer (BL layer), at least one green-sensitive emulsion layer (GL layer) and at least one red-sensitive emulsion layer (RL layer) on a support, wherein, a maximum absorption wavelength of the green-sensitive emulsion layer represented by λmax(G) being in the range of 500 nm≦λmax(G)≦570 nm, a maximum absorption wavelength of the blue-sensitive emulsion layer represented by λmax(B) being in the range of 440 nm≦λmax(B)≦500 nm, and the photographic material further having at least one short-wavelength-green-sensitive emulsion layer (CL layer) and at least one short-wavelength-blue-sensitive emulsion layer (VL layer) each meeting the following requirements (ix) and (x):

(ix) a maximum absorption wavelength of the CL layer represented by λmax(C) being in the range of 490 nm≦λmax(C)≦560 nm, and 80 nm≧λmax(G)−λmax(C)≧5 nm, and (x) a maximum absorption wavelength of the VL layer represented by λmax(V) being in the range of 400 nm≦λmax(V)≦460 nm, and 100 nm≧λmax(B)−λmax(V)≧5 nm.

14. The silver halide color photographic material according to claim 13, wherein the CL layer and/or the VL layer do not substantially form image dye.

15. The silver halide color photographic material according to claim 14, wherein a non-lightsensitive layer having a color mixing prevention ability, being provided between the CL layer and a lightsensitive emulsion layer other than the CL layer.

16. The silver halide color photographic material according to claim 13, wherein a non-lightsensitive layer having a color mixing prevention ability, being provided between the CL layer and a lightsensitive emulsion layer other than the CL layer.

17. A silver halide color photographic material comprising at least one blue-sensitive emulsion layer (BL layer), at least one green-sensitive emulsion layer (GL layer) and at least one red-sensitive emulsion layer (RL layer) on a support, wherein, a weight-averaged wavelength of spectral sensitivity distribution of the green-sensitive emulsion layer represented by λG being in the range of 500 nm≦λG≦570 nm, a weight-averaged wavelength of spectral sensitivity distribution of the blue-sensitive emulsion layer represented by λB being in the range of 440 nm≦λB≦500 nm, and the photographic material further having at least one short-wavelength-green-sensitive emulsion layer (CL layer) and at least one short-wavelength-blue-sensitive emulsion layer (VL layer) each meeting the following requirements (xi) and (xii):

(xi) a weight-averaged wavelength of spectral sensitivity distribution of the CL layer represented by λC being in the range of 490 nm≦λC≦560 nm, and 80 nm≧λG−λC≧5 nm, and (xii) a weight-averaged wavelength of spectral sensitivity distribution of the VL layer represented by λV being in the range of 400 nm≦λV≦460 nm, and 100 nm≧λB−λV≧5 nm.

18. The silver halide color photographic material according to claim 17, wherein the CL layer and/or the VL layer do not substantially form image dye.

19. The silver halide color photographic material according to claim 18, wherein a non-lightsensitive layer having a color mixing prevention ability, being provided between the CL layer and a lightsensitive emulsion layer other than the CL layer.

20. The silver halide color photographic material according to claim 18, wherein a non-lightsensitive layer having a color mixing prevention ability, being provided between the CL layer and a lightsensitive emulsion layer other than the CL layer.

* * * * *